US007624890B2

(12) United States Patent
Noble et al.

(10) Patent No.: US 7,624,890 B2
(45) Date of Patent: Dec. 1, 2009

(54) MULTIPLE COMPARTMENT CONTAINER

(75) Inventors: Terrence O. Noble, Burnsville, MN (US); Robert N. Priebe, Bloomington, MN (US); Scott Minger, Island Lake, IL (US)

(73) Assignee: Walgreen Co., Deerfield, IL (US)

( * ) Notice: Subject to any disclaimer, the term of this patent is extended or adjusted under 35 U.S.C. 154(b) by 28 days.

(21) Appl. No.: 11/982,741

(22) Filed: Nov. 2, 2007

(65) Prior Publication Data

US 2009/0114562 A1 May 7, 2009

(51) Int. Cl.
*B65D 45/16* (2006.01)
*B65D 83/04* (2006.01)

(52) U.S. Cl. ..... 220/324; 220/260; 206/538

(58) Field of Classification Search ..... 220/324, 220/315, 254.6, 254.3, 254.2, 254.1, 826, 220/822, 820, 810, 837, 836, 507, 503, 259.2, 220/259.1, 256.1, 263, 262, 260, FOR. 207, 220/FOR. 204, FOR. 203; 206/538, 539, 206/528; D3/203.2, 203.1, 201; D9/423, D9/421, 420; 215/305; 222/531, 153.03
See application file for complete search history.

(56) References Cited

U.S. PATENT DOCUMENTS 3,037,616 A * 6/1962 Phipps, III ..... 206/5
3,450,306 A * 6/1969 Gill ..... 221/71
3,861,556 A 1/1975 Barecki et al.
4,284,200 A 8/1981 Bush et al.
4,372,445 A * 2/1983 Keffeler ..... 206/532
4,607,768 A 8/1986 Taber et al.
4,739,900 A 4/1988 Borst
4,809,868 A * 3/1989 Pomroy ..... 220/260
4,898,292 A 2/1990 VerWeyst et al.
4,901,892 A 2/1990 Song
4,911,337 A 3/1990 Rosenthal
5,163,559 A * 11/1992 Bunin ..... 206/532
5,273,177 A 12/1993 Campbell
5,573,132 A 11/1996 Kanfer et al.
5,685,444 A 11/1997 Valley
5,699,912 A 12/1997 Ishikawa et al.
D418,288 S * 1/2000 Priebe ..... D3/203.3
6,065,626 A 5/2000 Huang et al.
6,206,221 B1 3/2001 Bando et al.
6,394,298 B1 5/2002 Zaidman
6,510,971 B1 1/2003 Martin
6,655,544 B1 12/2003 Tanaka et al.
6,732,873 B2 5/2004 Bried et al.
6,742,666 B1 6/2004 Bried et al.
6,902,077 B1 6/2005 Tack et al.
7,021,483 B2 4/2006 Tack et al.
7,172,093 B2 2/2007 Bando
7,228,984 B2 6/2007 Tack et al.
2003/0038053 A1* 2/2003 Bramen ..... 206/538
2003/0043026 A1* 3/2003 Noble et al. ..... 340/309.15
2004/0089581 A1* 5/2004 Dienst ..... 206/538
2005/0161364 A1* 7/2005 DeJonge ..... 206/538

* cited by examiner

*Primary Examiner*—Anthony Stashick
*Assistant Examiner*—Robert J Hicks
(74) *Attorney, Agent, or Firm*—Francis C. Kowalik; Marshall, Gerstein & Borun LLP

(57) ABSTRACT

The present disclosure provides a lid arrangement for a container with a hinged mating lid. The disclosed lid arrangement avoids inadvertently opening the lid, while at the same time allows easy opening when opening the lid is desired. The lid arrangement is configured to be used with a wide variety of different types of containers with hinged lids. In some embodiments, the lid arrangement is incorporated into a multiple compartment pill container.

13 Claims, 32 Drawing Sheets

MULTIPLE COMPARTMENT CONTAINER

TECHNICAL FIELD

The present disclosure relates generally to containers with hinged mating lids and a method of using and manufacturing the containers. The containers commonly include multiple compartments for storing pills.

BACKGROUND

Containers with hinged mating lids are known. One type of such containers includes multiple compartments therein. See for example U.S. Pat. No. 6,000,546 titled Lockable Pill Container assigned to Apothecary Products, Inc. Such multiple compartment containers are commonly used as pill containers, as each compartment can be marked to correspond to a different day of the week or time of the day when the pills are to be consumed. A multiple compartment container which is easy to use, has sufficient capacity for the patient's needs, and which can be conveniently carried by the user increases the likelihood that the user will take the correct medicine at the correct time. The present disclosure provides an improved lid configuration for a variety of containers including multiple compartment pill containers.

SUMMARY

The present disclosure provides a lid arrangement for a container with a hinged mating lid. The disclosed lid arrangement avoids inadvertently opening the lid, while at the same time allows easy opening when opening the lid is desired. The lid arrangement is configured to be used with a wide variety of different types of containers with hinged lids. In some embodiments, the lid arrangement is incorporated into a multiple compartment pill container.

DETAILED DESCRIPTION

Figure 1:
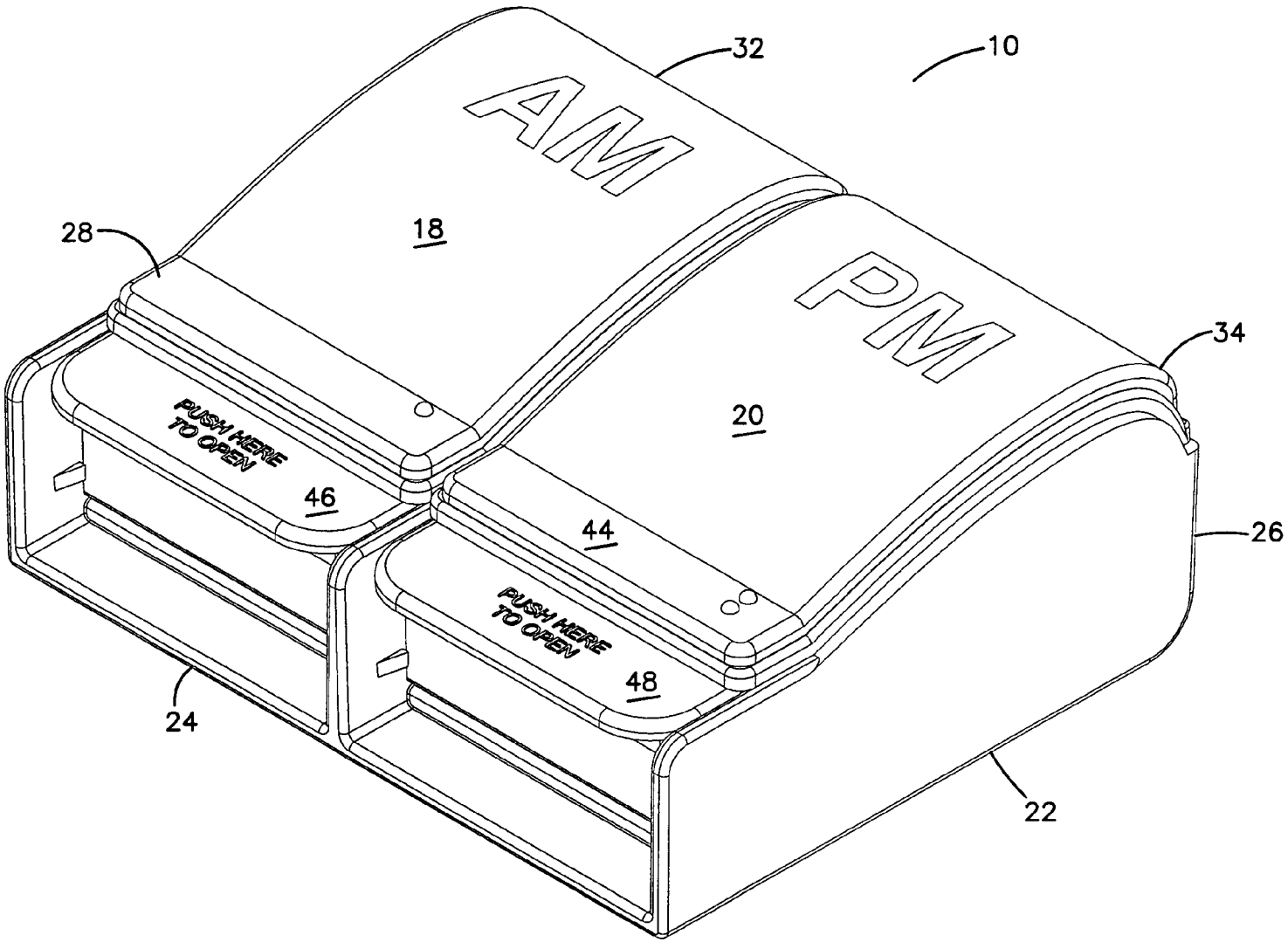
FIG. 1 is a perspective view of a two-compartment container in a closed position according to a first embodiment of the present disclosure.
Figure 2:
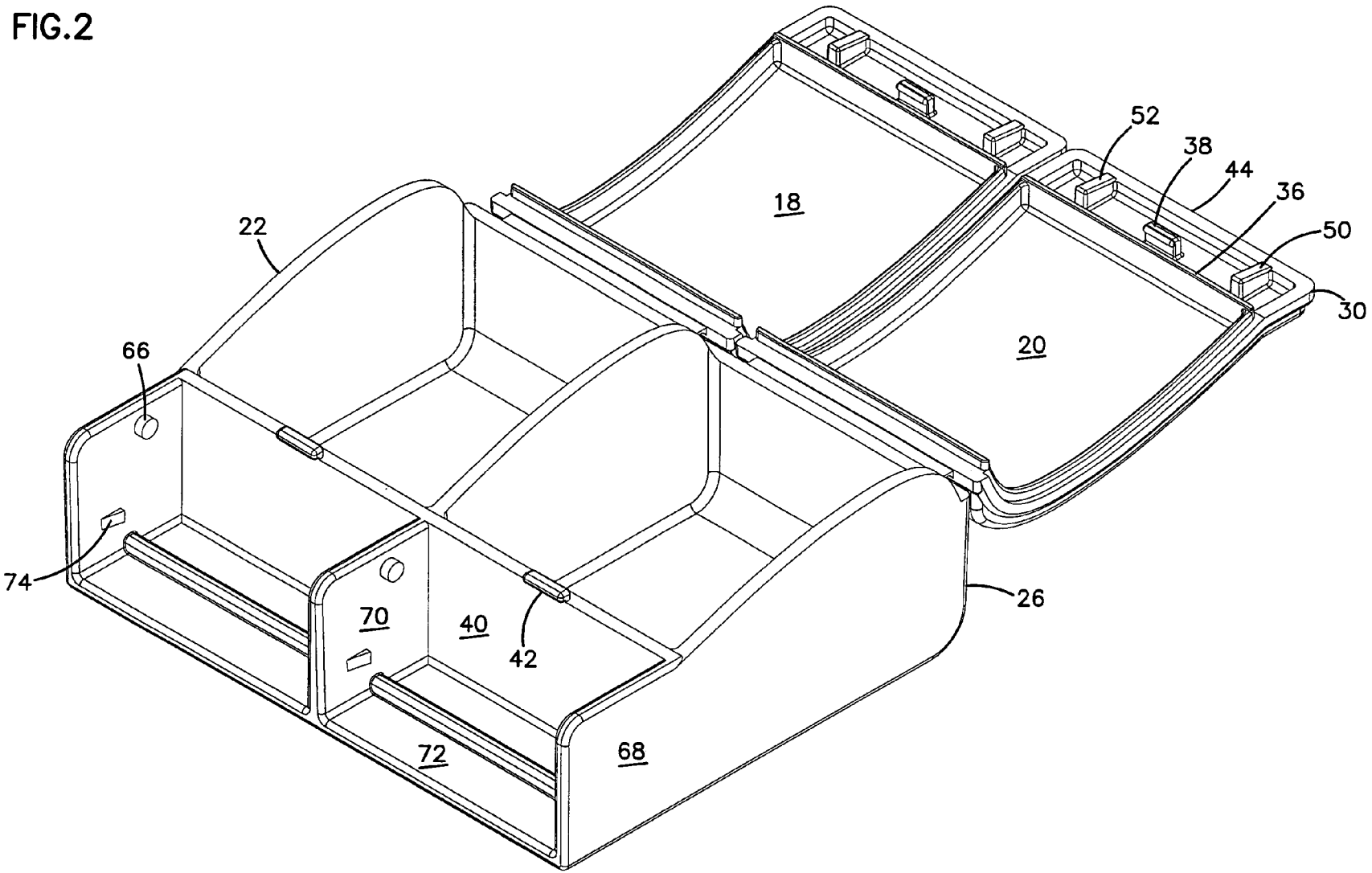
FIG. 2 is a perspective view of the container of FIG. 1 in an open position.
Figure 3:
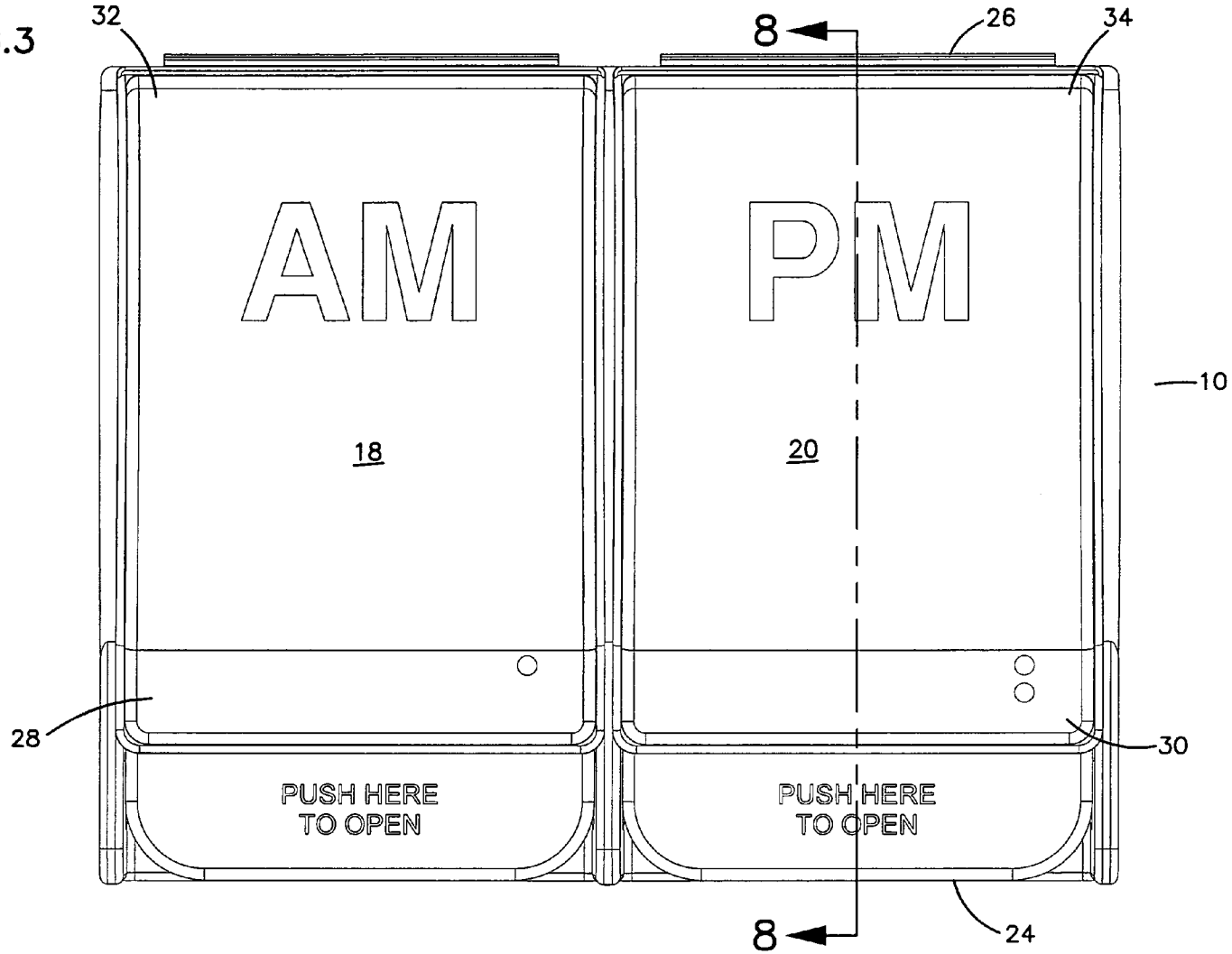
FIG. 3 is a top view of the container of FIG. 1 in a closed position.
Figure 4:
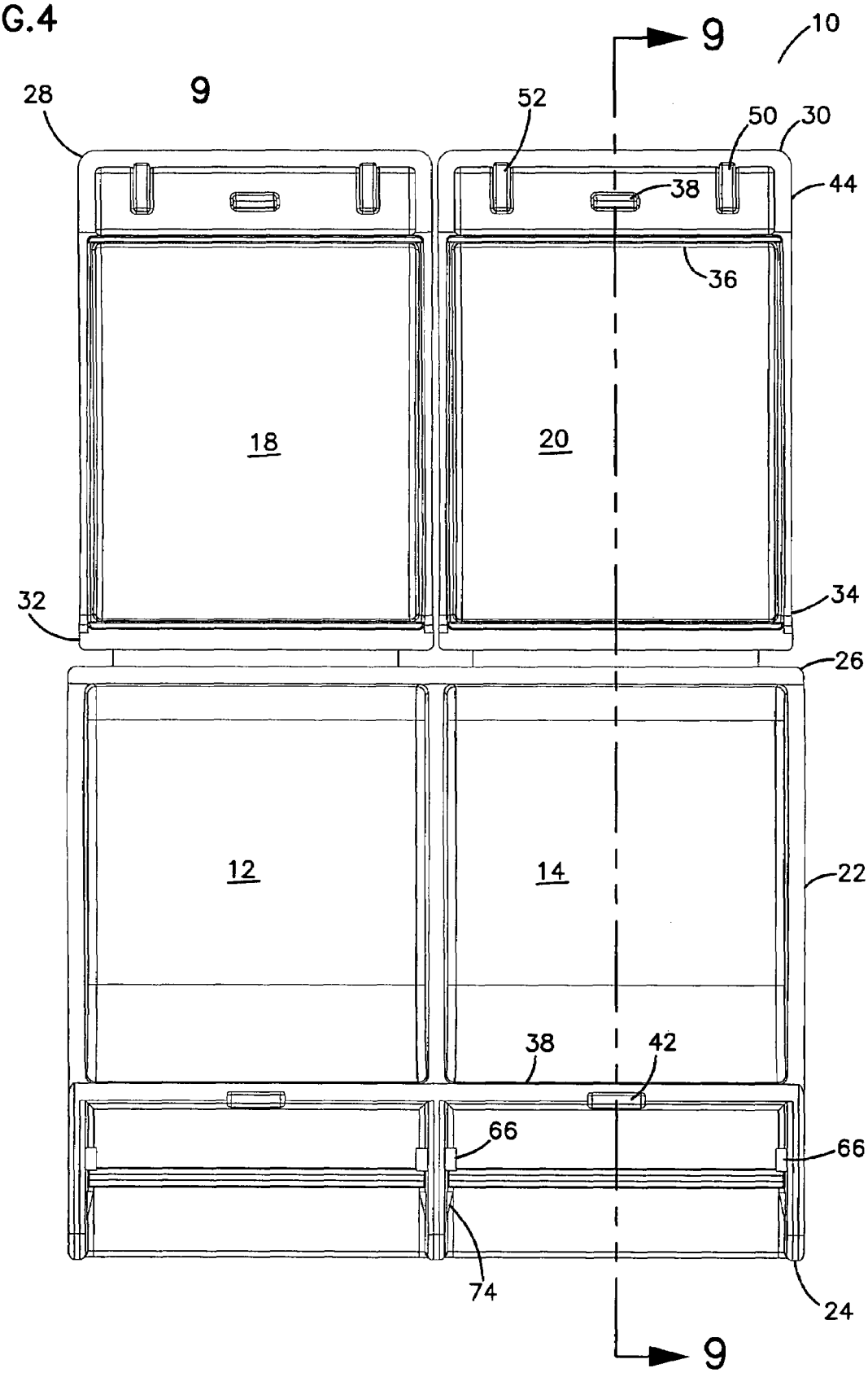
FIG. 4 is a top view of the container of FIG. 1 in an open position.
Figure 5:
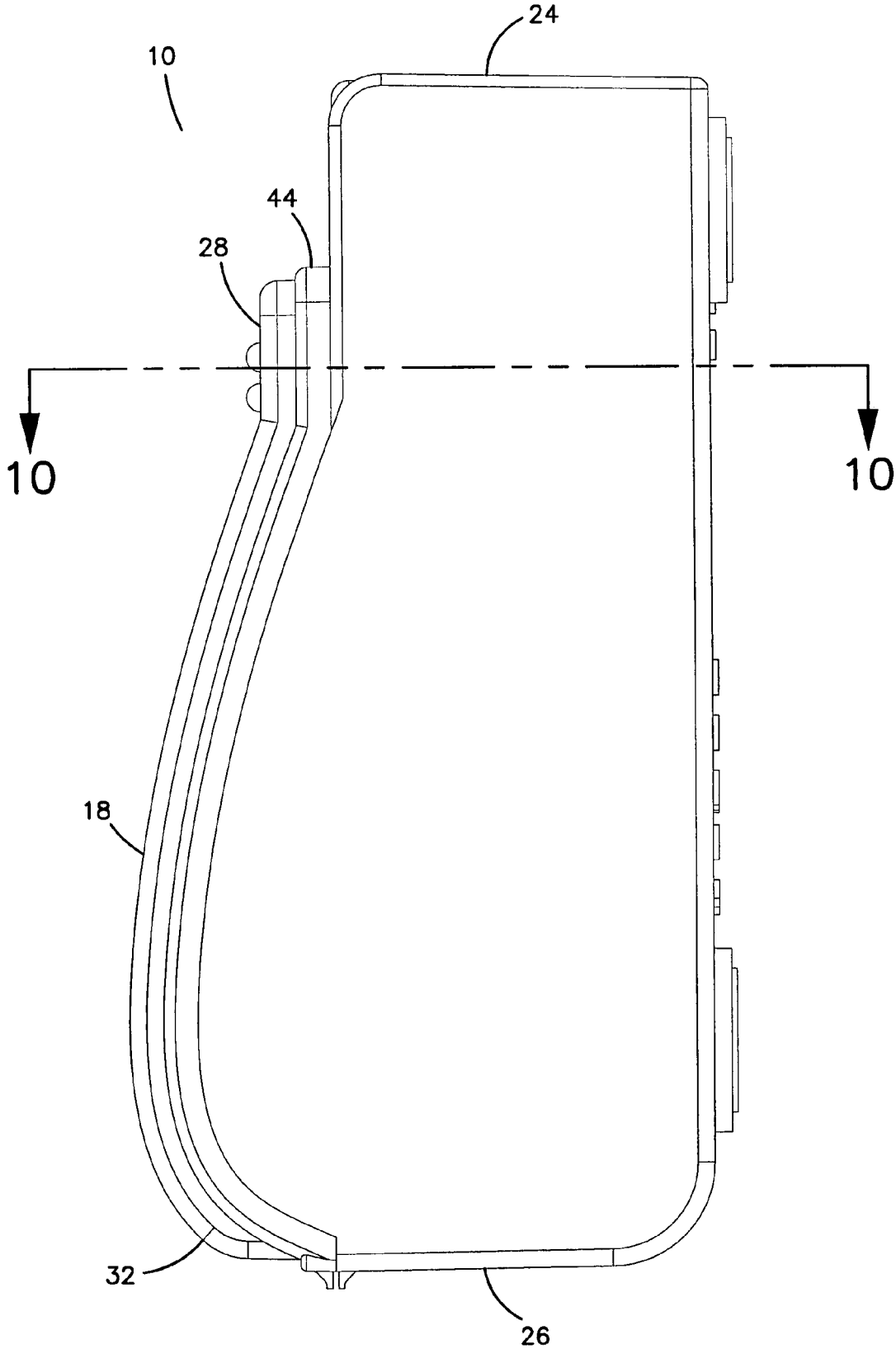
FIG. 5 is a side view of the container of FIG. 1 in a closed position.
Figure 6:
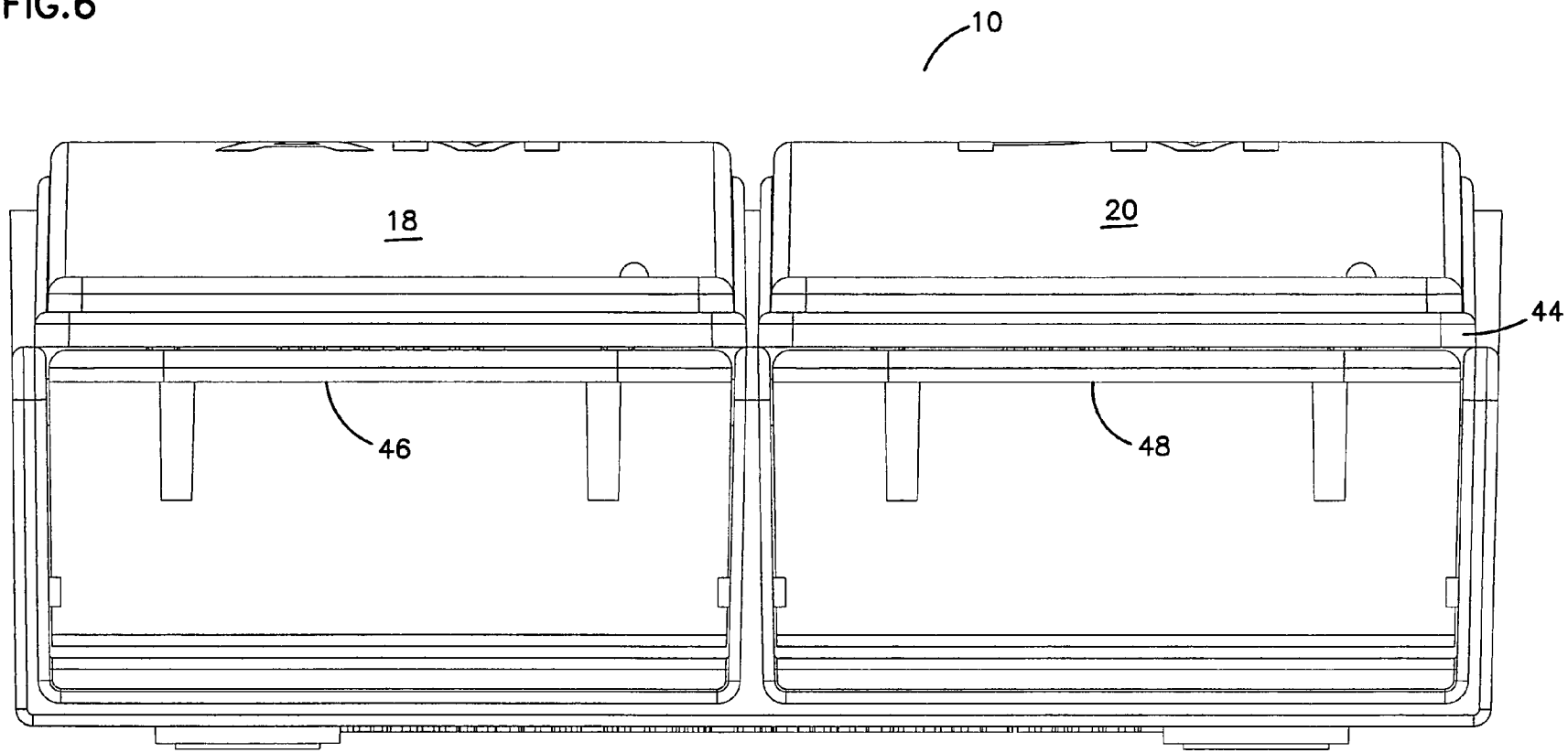
FIG. 6 is a front view of the container of FIG. 1 in a closed position.
Figure 7:
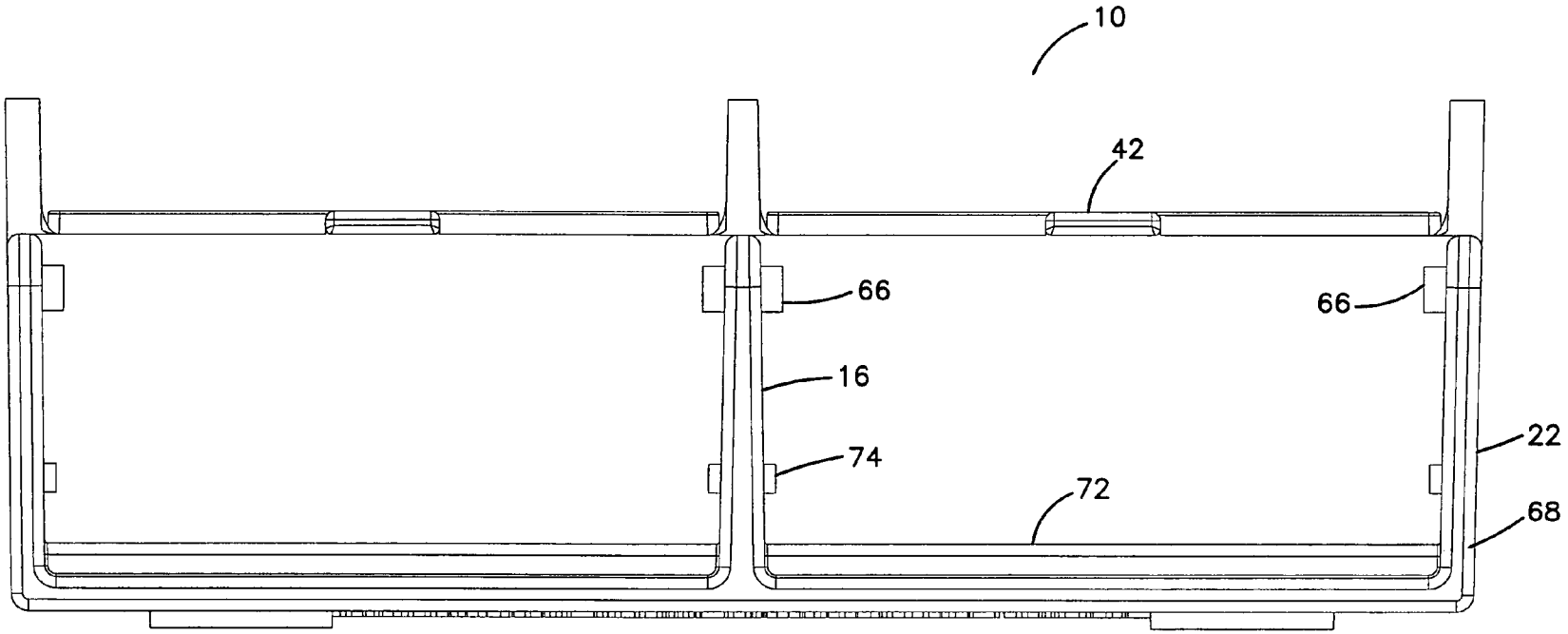
FIG. 7 is a front view of the container of FIG. 1 in a fully opened position.

Referring to FIGS. 1-13, a first embodiment of a container according to the present disclosure is shown. In the depicted embodiment, the container 10 includes two compartments, otherwise referred to as cavities. The first cavity 12 and second cavity 14 are shown separated by a partition wall 16. A first cap member 18 is shown with the surface markings AM, and a second cap member 20 is shown with the surface markings PM. The cap members are also referred to herein interchangeably as caps, lids, lid members, and covers. In the depicted embodiment, the container is a pill or vitamin container configured to store pills for consumption in the morning and in the evening. The markings indicate that morning pills are housed within the first cavity 12, and the evening pills are housed within the second cavity 14. In the depicted embodiment, the cavities 12, 14 can be selectively accessed because the caps 18, 20 are movable independent of each other. In other words, cap 18 can be in the opened position whether or not cap 20 is opened or closed. In the depicted embodiment the caps 18, 20 can be unlocked by depressing tabs 46, 48.

Still referring to FIGS. 1-13, the lid assembly of the container 10 is described in greater detail. In the depicted embodiment the cavities 12 and 14 are defined within base member 22 of the container 10. The base member 22 includes a front end portion 24 and a rear end portion 26. The front end portion 24 is the end of the base member 22 closest to front ends 28, 30 of the lids 18, 20, and the rear end portion 26 is the portion of the base member 22 is the end of the base member 22 closest to the rear ends 32, 34 of the lids 18, 20. In the depicted embodiments the rear end portion 26 of the base 22 is connected to the rear ends 32, 34 of the lids 18, 20. In the depicted embodiment, the base 22 and the lids are integrally molded into a single piece, and are connected by a flexible living hinge. It should be appreciated that many alternative embodiments of the lid assembly exist. For example, it should be appreciated that in alternative embodiments the lid may not be integral with the base. Some of such embodiments will be described in greater detail below.

Figure 8:
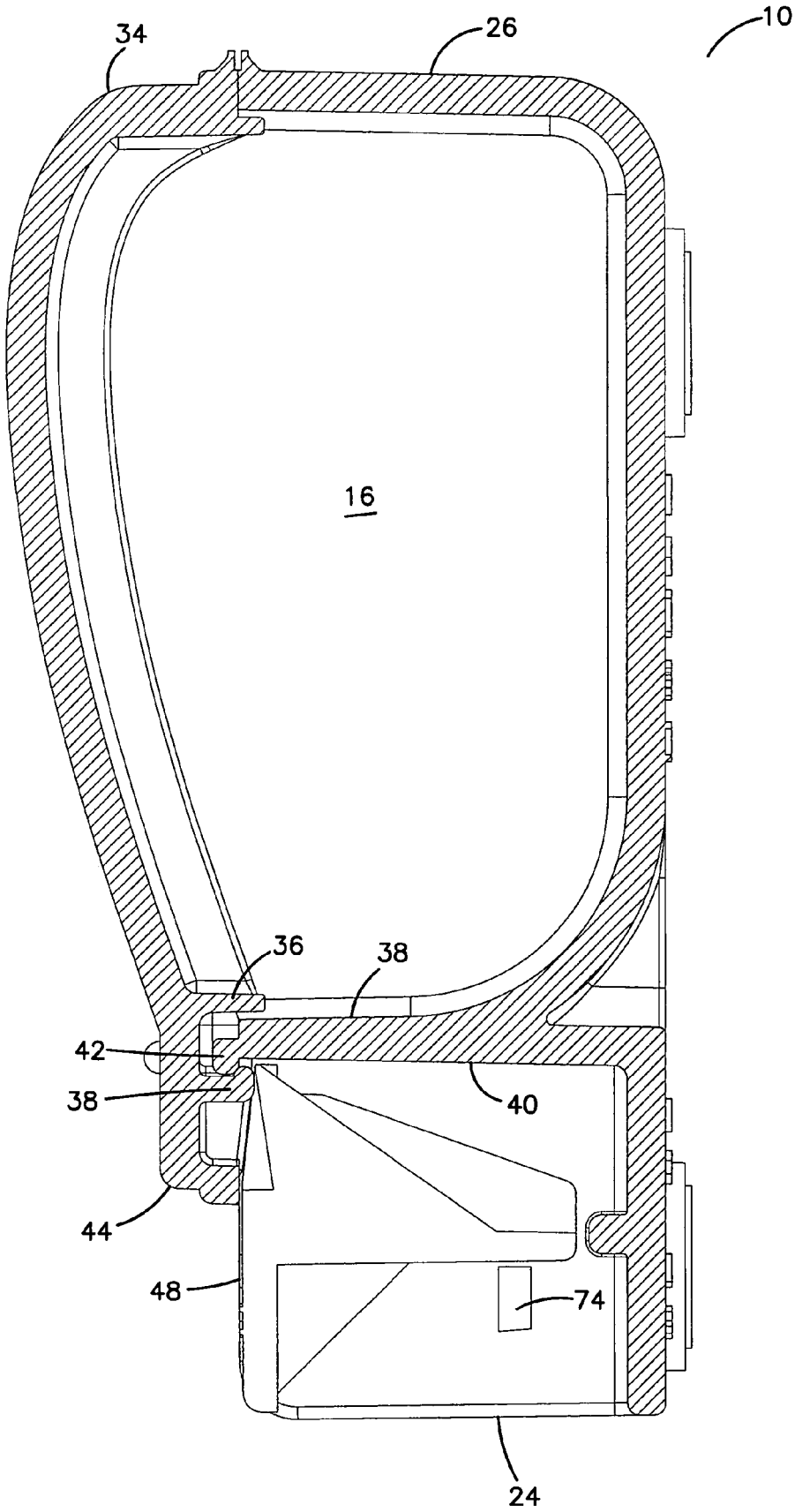
FIG. 8 is a cross-sectional view of the container along lines 8-8 of FIG. 3.
Figure 9:
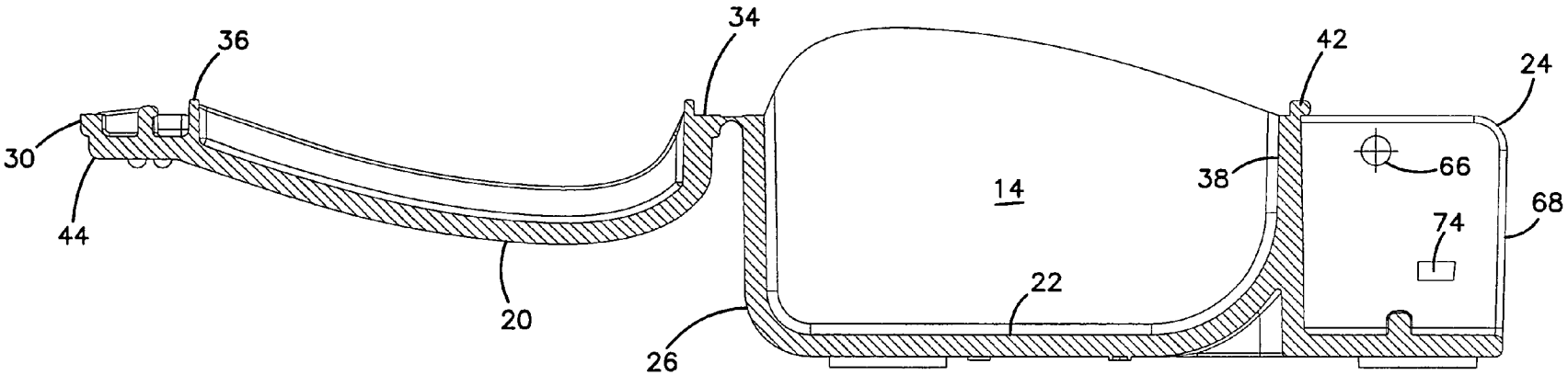
FIG. 9 is a cross-sectional view of the container along lines 9-9 of FIG. 4.
Figure 10:
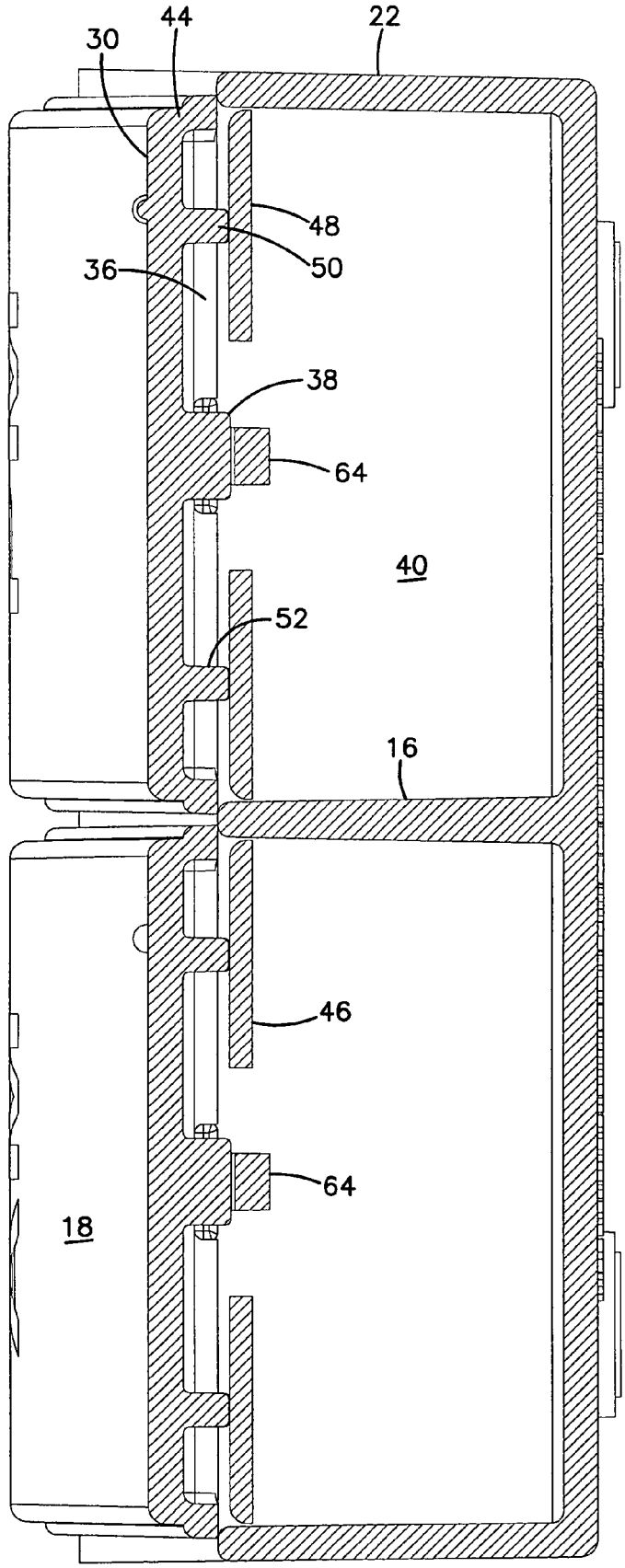
FIG. 10 is a cross-sectional view of the container along lines 10-10 of FIG. 5.

Referring to FIGS. 8-10, the front ends 28, 30 of the lids 18, 20, and the front end 24 of the base member 22 are described in greater detail. In the depicted embodiment the front ends 28, 30 of lids 18, 20 are identical, therefore, only front end 30 will be described in further detail. The front end 30 of lid 20 is configured to mate with a front wall of the base member 22. In the depicted embodiment the front end 30 of the lid 20 includes a lip member 36 that extends across the front end 30 of the lid 20. The lip member 36 engages the inside surface 38 of the front wall of the base member 22. In the depicted embodiment the engagement of the lip member 36 and the inside surface 38 of the front wall of the base member 22 contact each other and substantially seals the front end 30 of the lid 20 with the front end 24 of the base member 22. In the depicted embodiment the sides of the lids 18, 20 are configured to engage a side wall of the container 10 or the partition wall 16 of the container. The lids 18, 20 are configured such that a portion of the lids 18, 20 fit within the cavity when the lids 18, 20 are in the closed potion.

In the depicted embodiment, the front end 30 of the lid 20 also includes a downwardly extending locking arm 38 that is configured to engage the outside surface 40 of the front wall. The downwardly extending locking arm 38 includes a hooked end and is configured to deflect and engage a catch 42 on the outside surface 40 of the front wall. In the depicted embodiment the locking arm 38 and catch 42 are aligned with the center of the cavity 14. The front end 30 of lid 20 further includes a forwardly extending foot portion 44 that is configured to rest on the tab 48. The foot portion 44 includes a stepped front and side profile. The stepped profile makes the foot portion 44 less likely to inadvertently catch on something and pull the lid 20 to an unlocked position. In the depicted embodiment the underside of the foot portion 44 includes two spaced apart stand offs 50, 52 that are configured to extend towards and contact the top surface of the tab 48.

Figure 11:
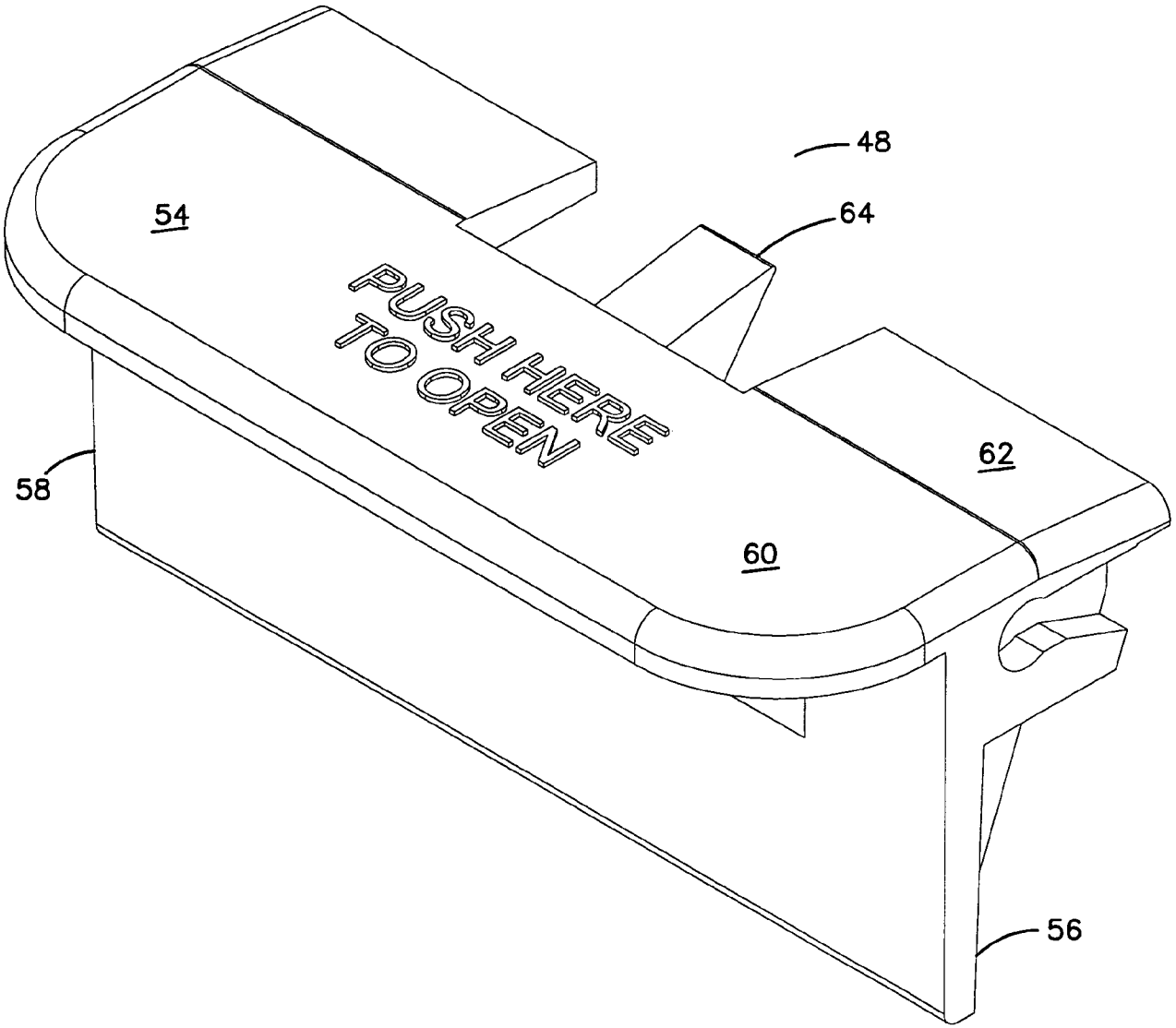
FIG. 11 is a perspective view of the tab of FIG. 1.
Figure 12:
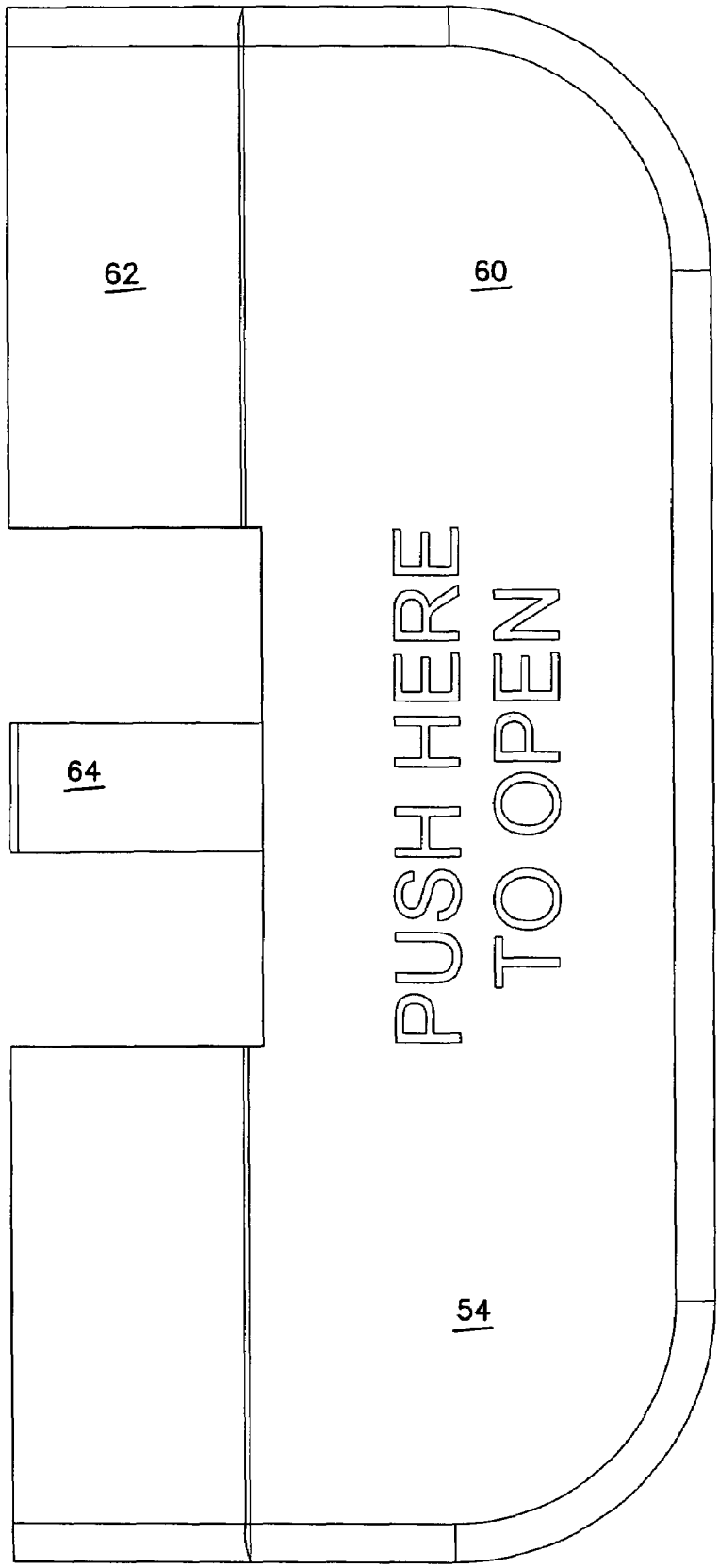
FIG. 12 is a top view of the tab of FIG. 11.
Figure 13:
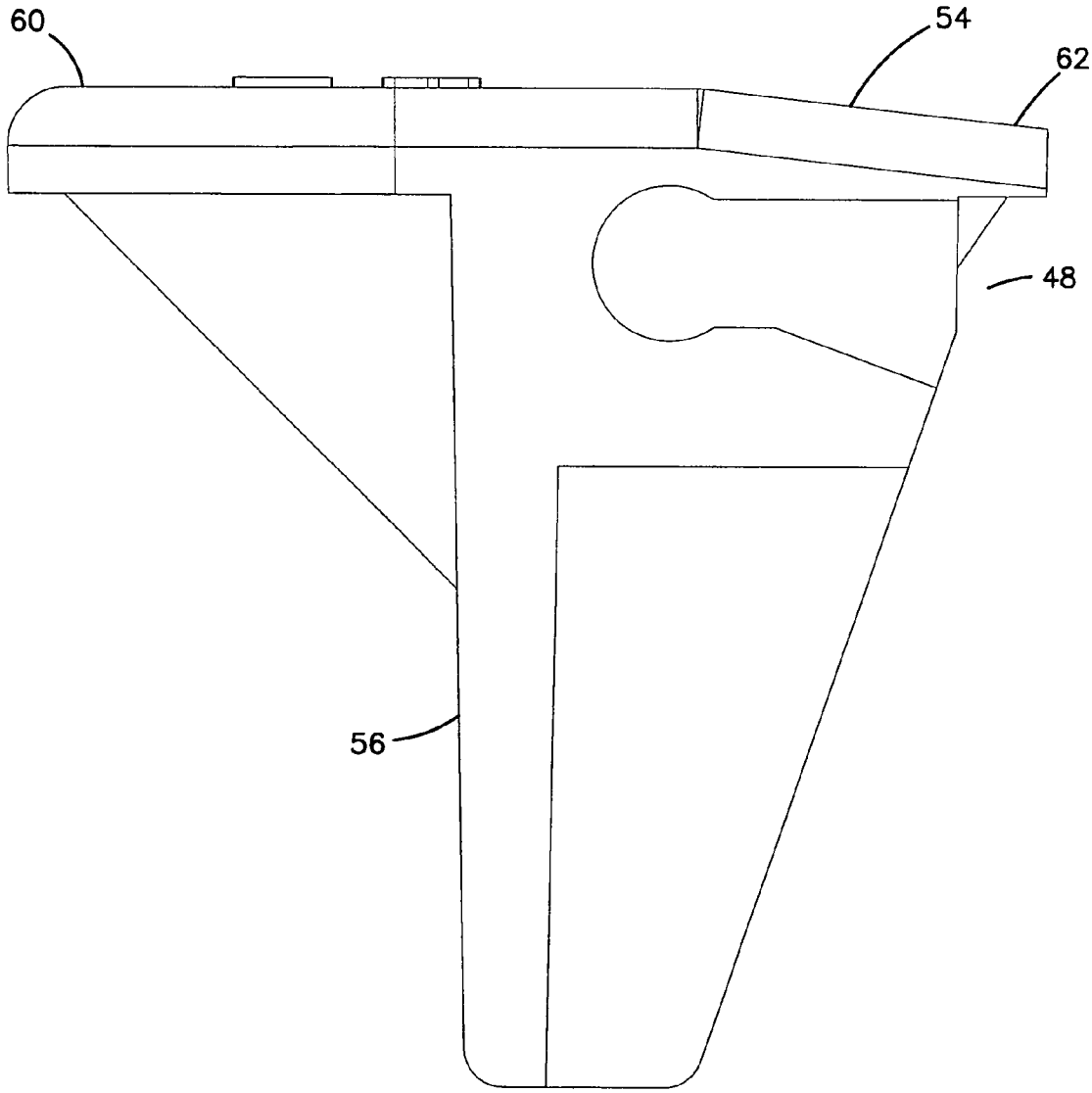
FIG. 13 is an end view of the tab of FIG. 11.

Referring to FIGS. 11-13, the tab 48 is described in greater detail. In the depicted embodiment the tab 48 includes a top surface 54, a first end portion 56, and a second end portion 58. The top surface 54 includes front portion 60 and a back portion 62. The back portion 62 is configured to pivot upwards when the front portion 60 is moved downwards. The back portion 62 is configured to raise the foot portion 44 of the lid 20 and release the locking arm 38 from the catch 42 when the front portion 60 is depressed. In the depicted embodiment the back portion 62 includes two end portions separated by a center member 64. The center member is configured to contact the bottom of the locking arm 38 and move from the engaged position to a disengaged position. The end portions on either side of the center member 64 are configured to contact the stand offs 50, 52 and move them upwards when the front portion 60 of the tab is depressed.

In the depicted embodiment the first end portion 56 and the second end portion 58 include recesses that are configured to engage pivot protrusions 66 on the front end portion 24 of the base member 22. The recesses are configured to slide into and snap into engagement with the pivot protrusions 66. In the depicted embodiment, the tab 48 is configured such that that front portion does not extend farther than the front end 24 of the base member 22. The top surface 54 of the tab 48 does not extend above the front end 24 of the base member 22. The disclosed configuration prevents the tab 48 from being inadvertently actuated. In the depicted embodiment front end 24 of the base member includes tab guard wall that extend from the cavity to house the tab. In the depicted embodiment tab 48 is shielded from the sides by vertical guard walls 68, 70 and from the bottom by a horizontal guard wall 72. In the depicted embodiment the vertical guard walls 68, 70 include stops 74 to limit the rotation of the tab 48.

Figure 14:
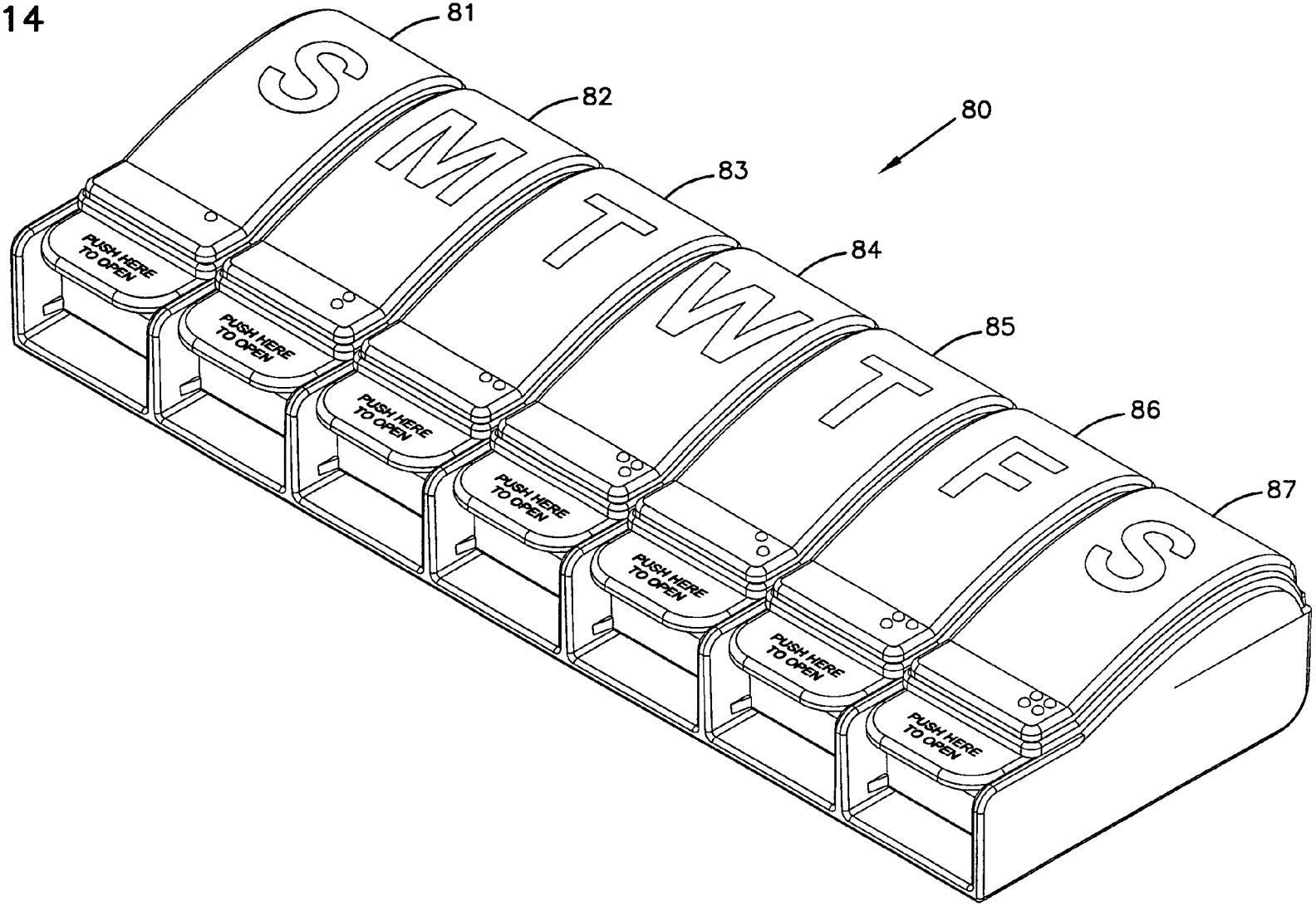
FIG. 14 is a perspective view of a seven-compartment container in a closed position according to a second embodiment of the present disclosure.
Figure 15:
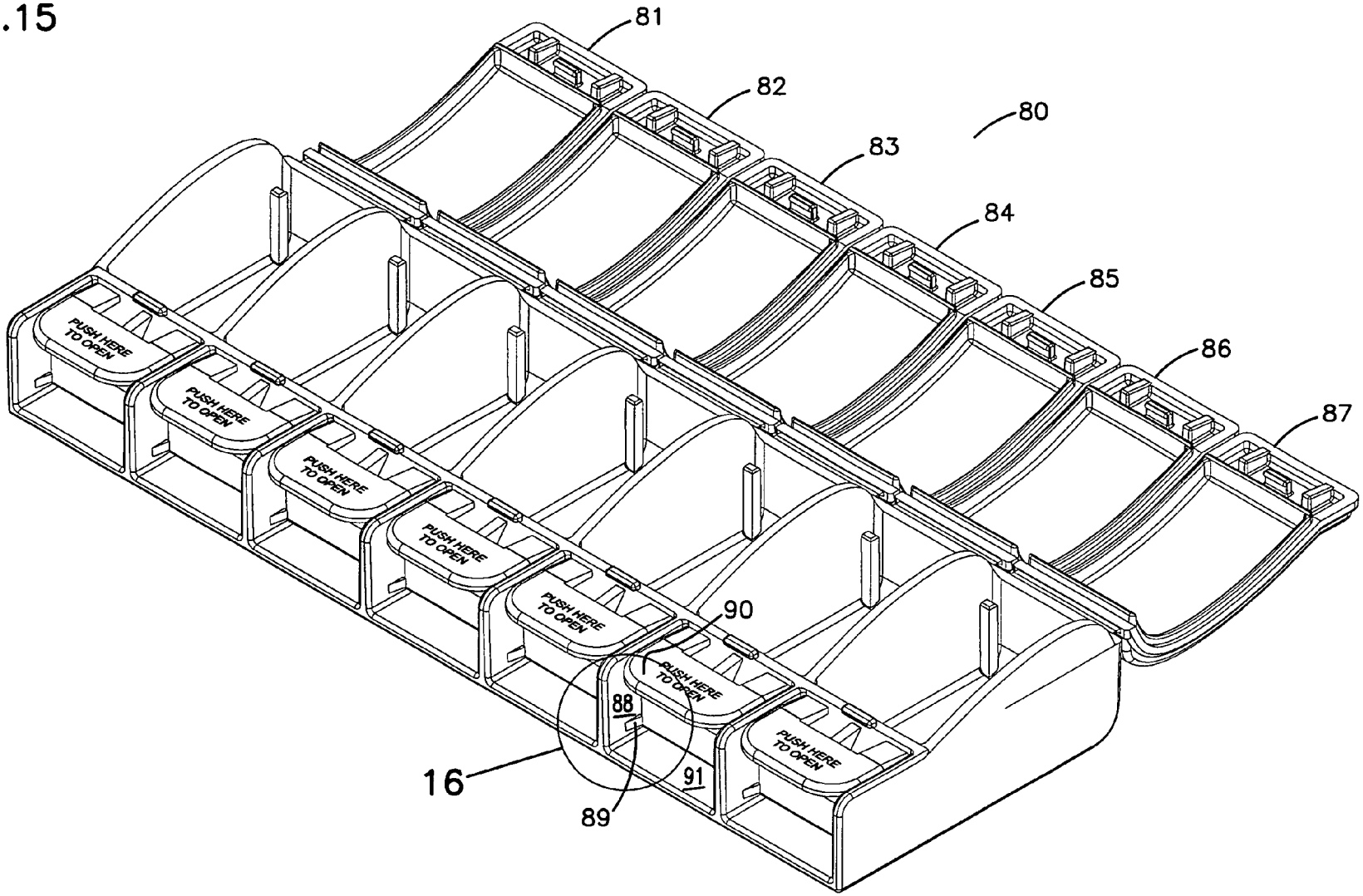
FIG. 15 is a perspective view of the container of FIG. 14 in an open position.
Figure 16:
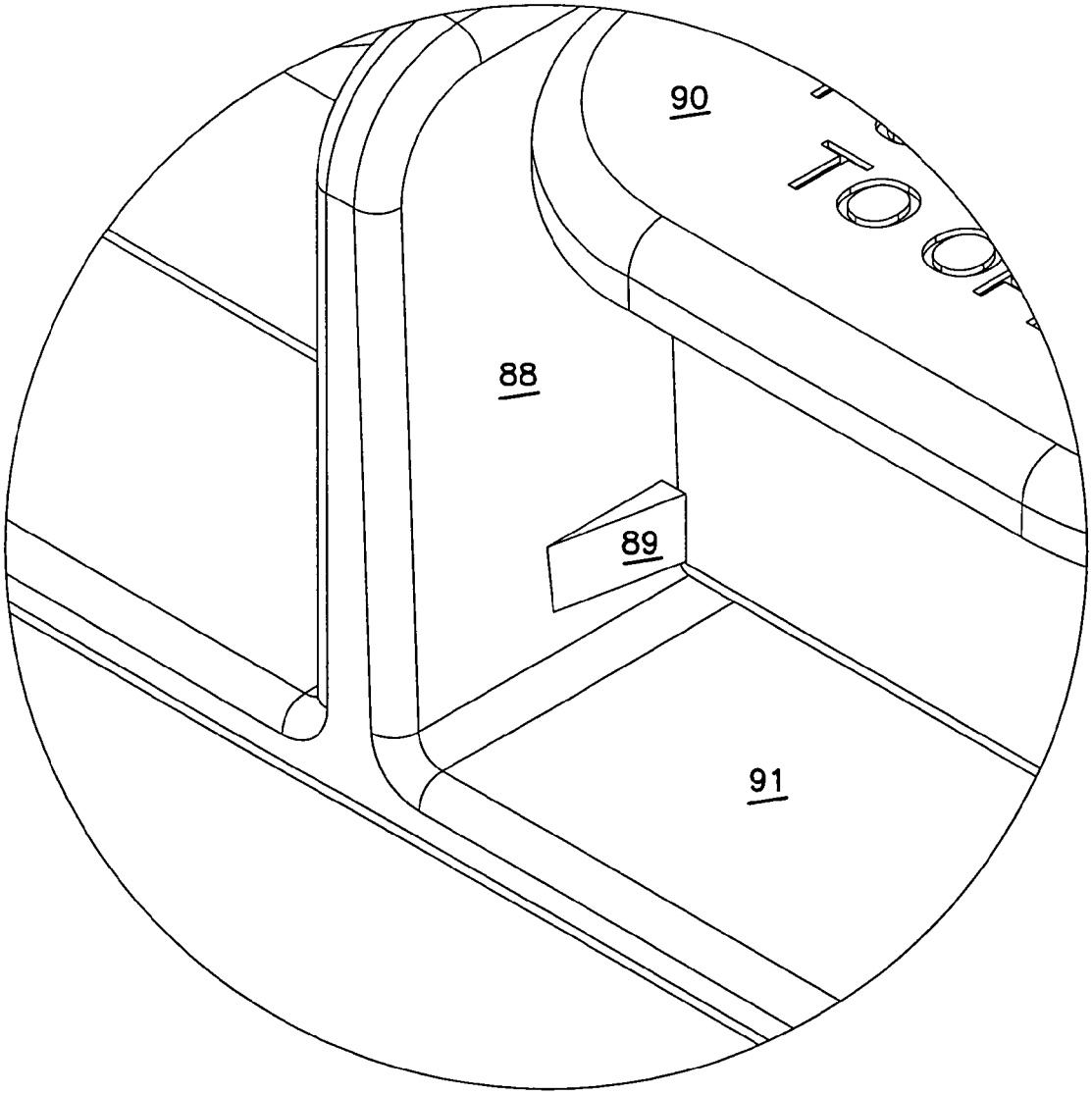
FIG. 16 is a perspective view of a portion of the container of FIG. 14.
Figure 17:
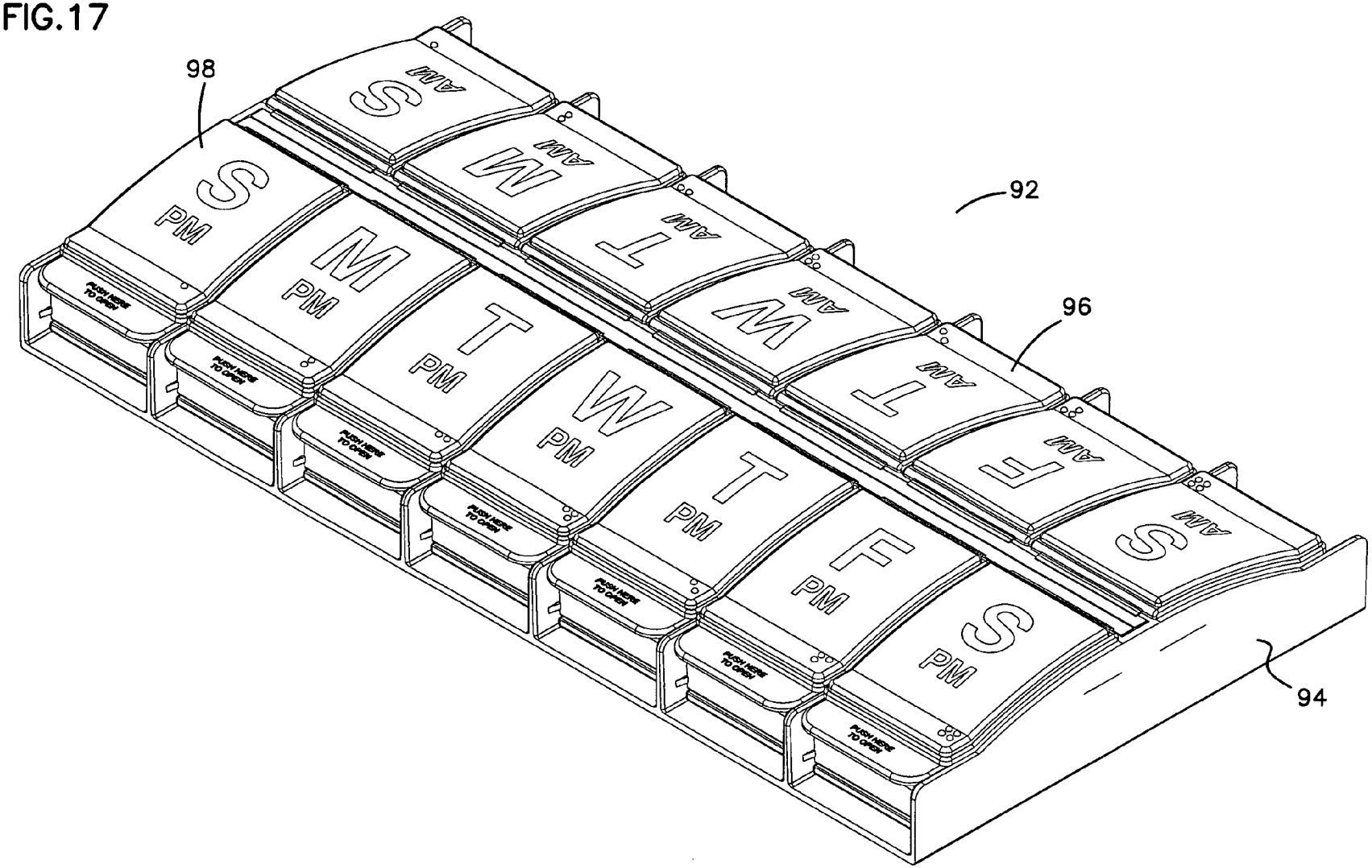
FIG. 17 is a perspective view of a fourteen compartment container in a closed position according to a third embodiment of the present disclosure.
Figure 18:
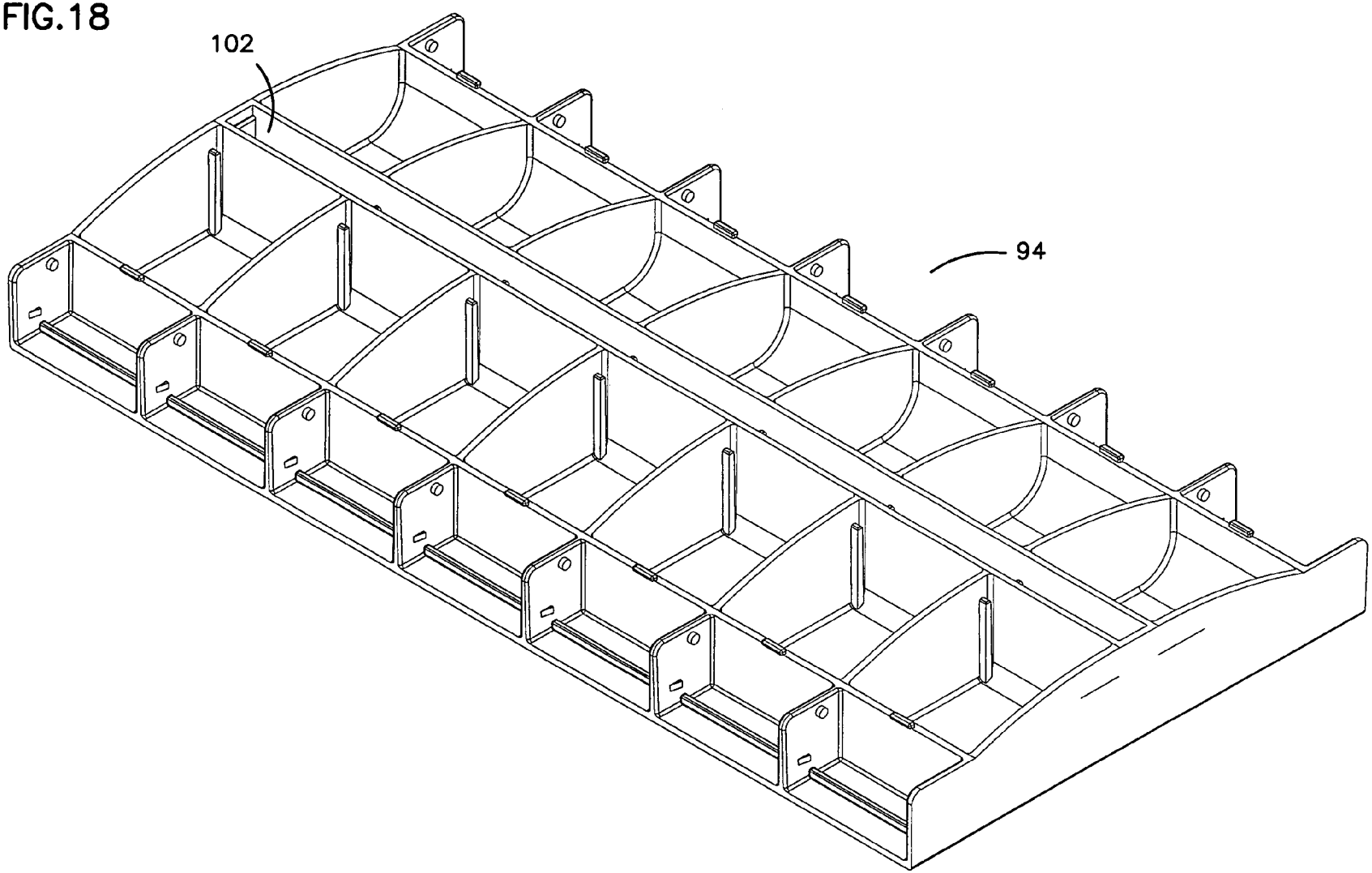
FIG. 18 is a perspective view of a base of the container of FIG. 17.
Figure 19:
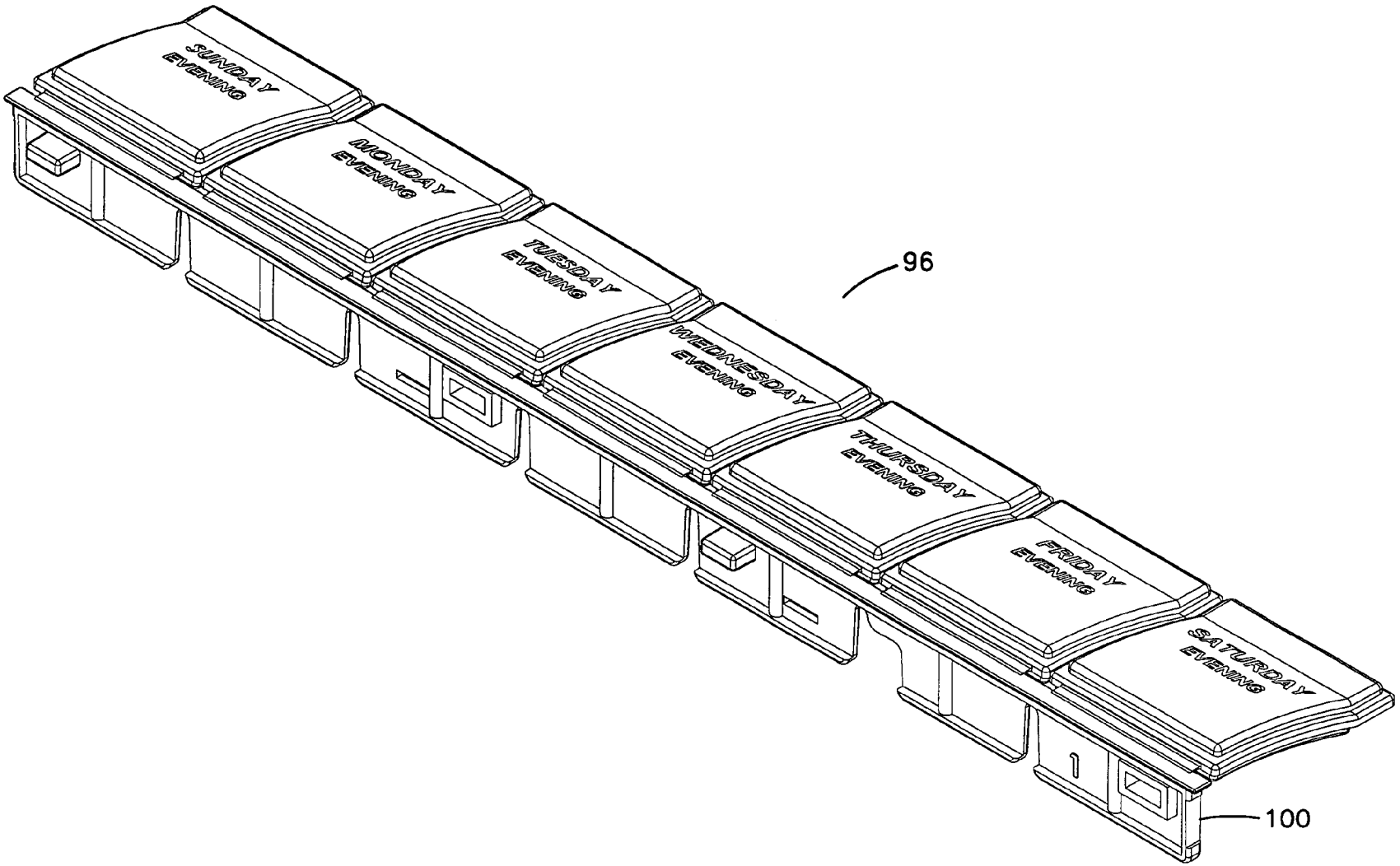
FIG. 19 is a perspective view of a portion of the lid of the container of FIG. 17.
Figure 20:
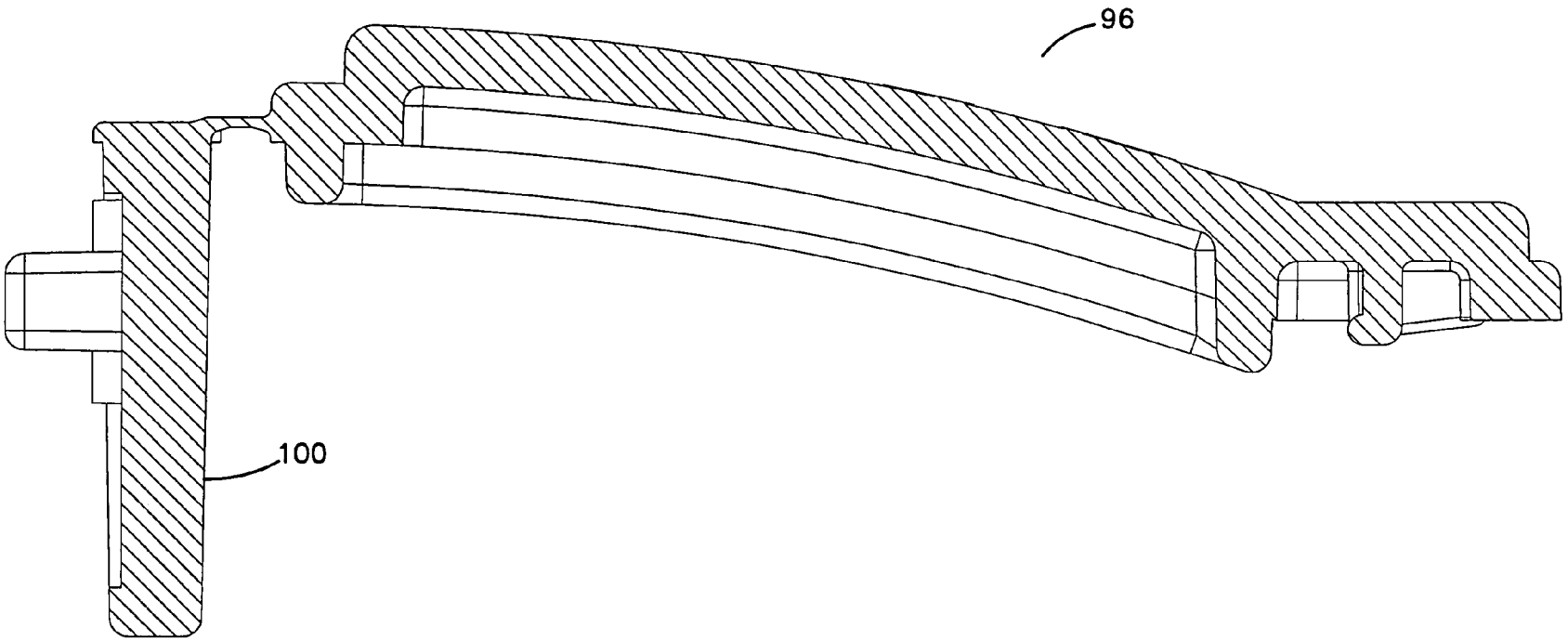
FIG. 20 is a cross-sectional view of the lid of FIG. 19.
Figure 21:
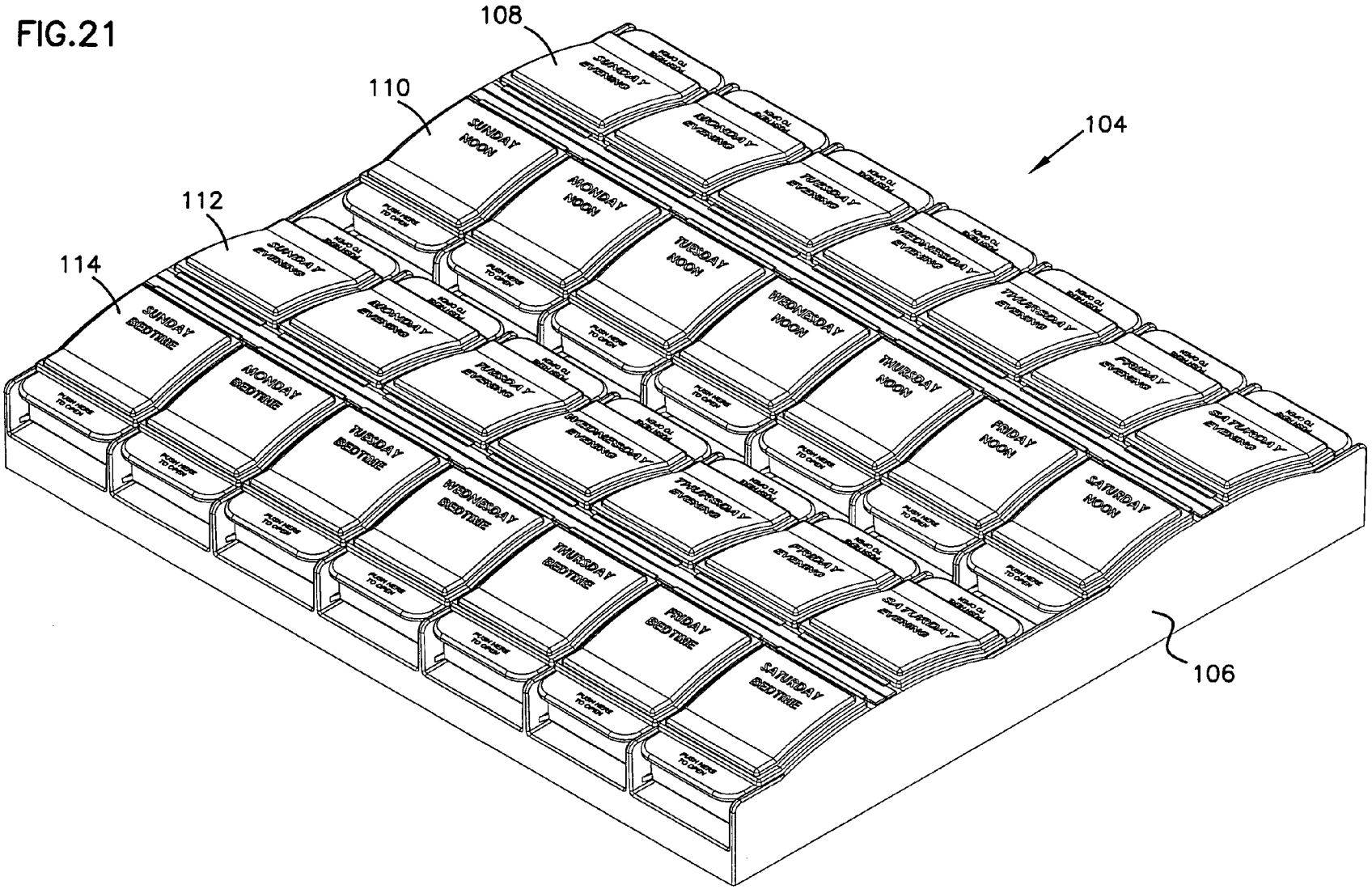
FIG. 21 is a perspective view of a twenty eight compartment container in a closed position according to a fourth embodiment of the present disclosure.
Figure 22:
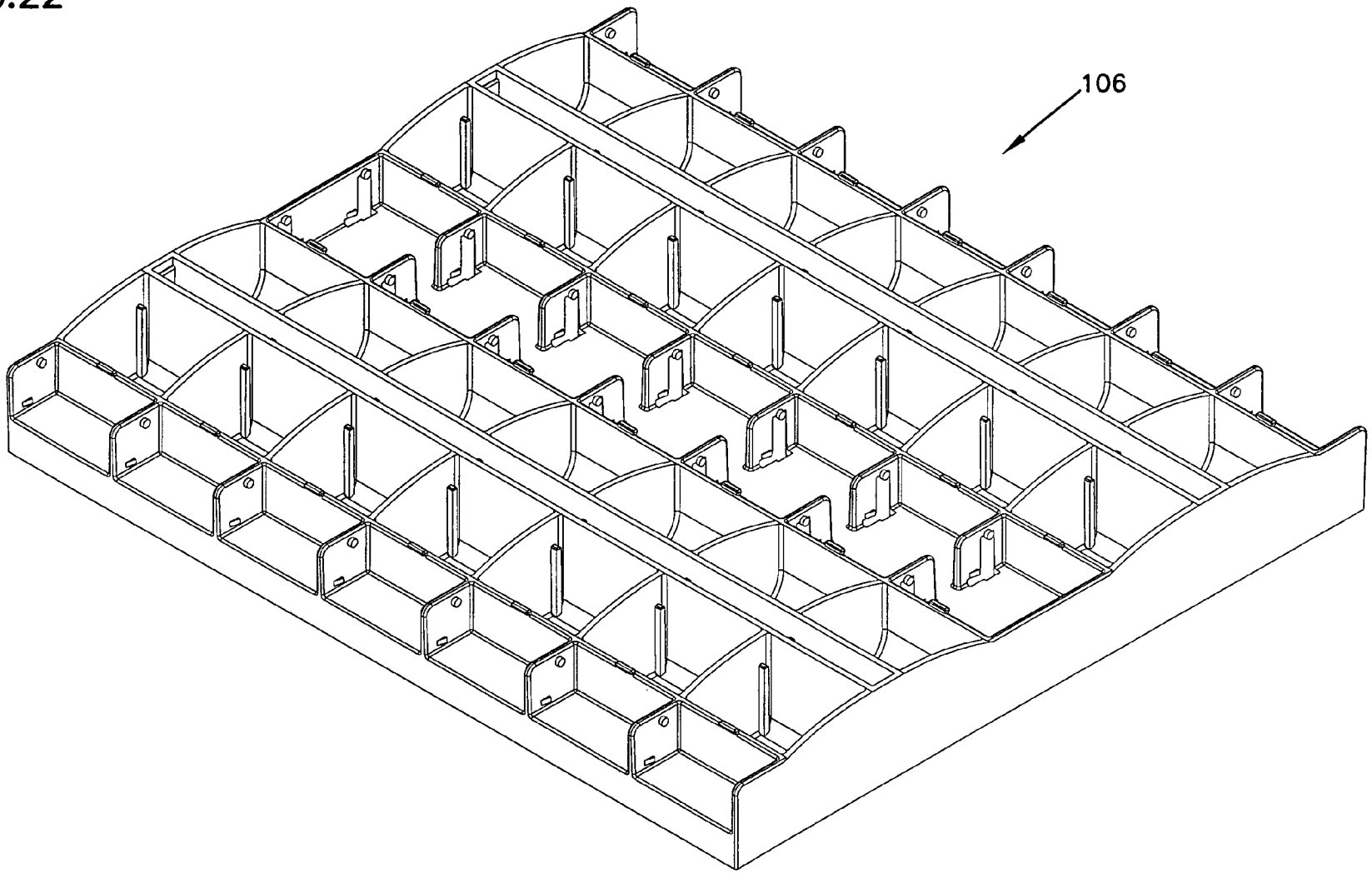
FIG. 22 is a perspective view of a base of the container of FIG. 21.
Figure 23:
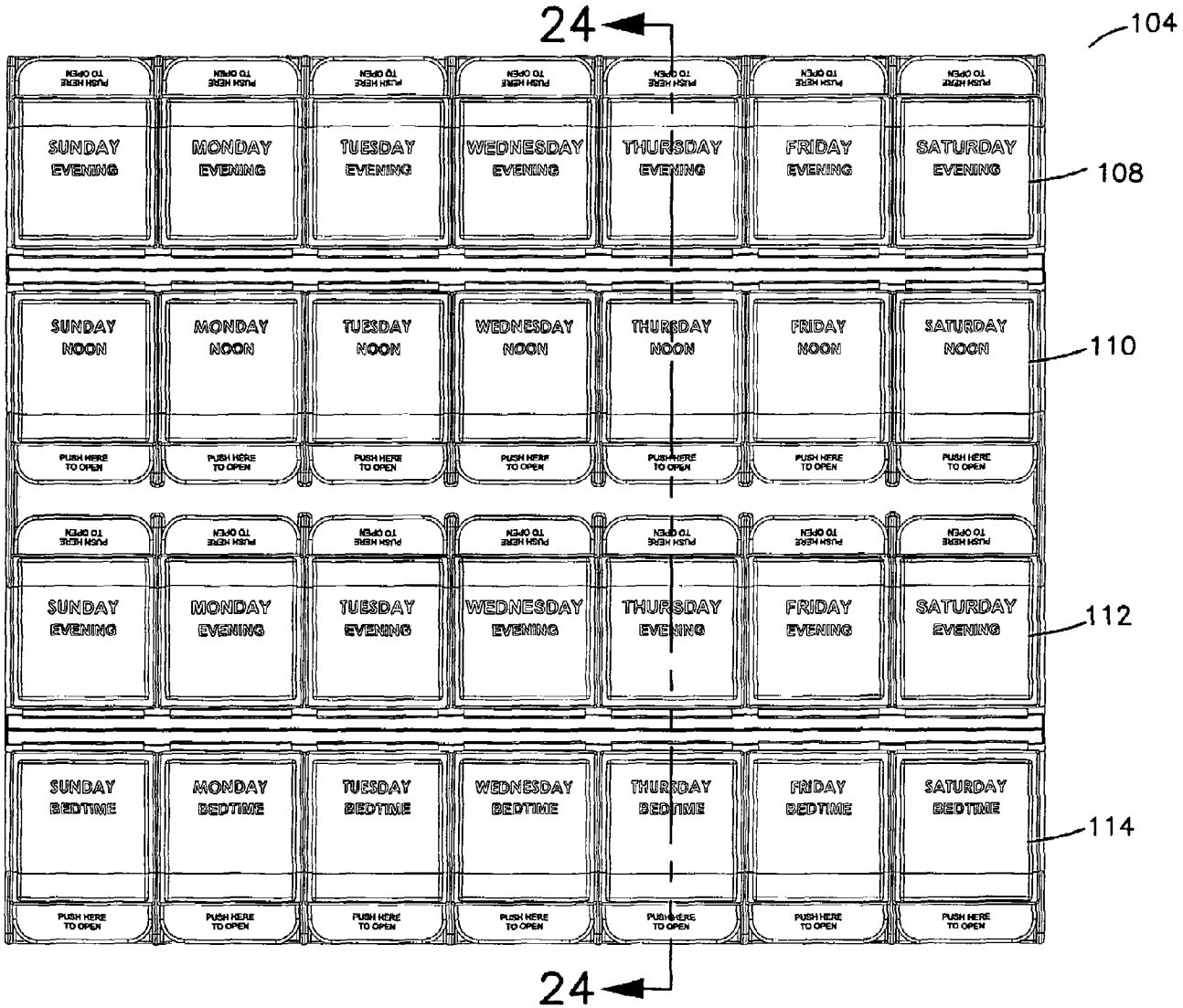
FIG. 23 is a top view of the container of FIG. 21.
Figure 24:
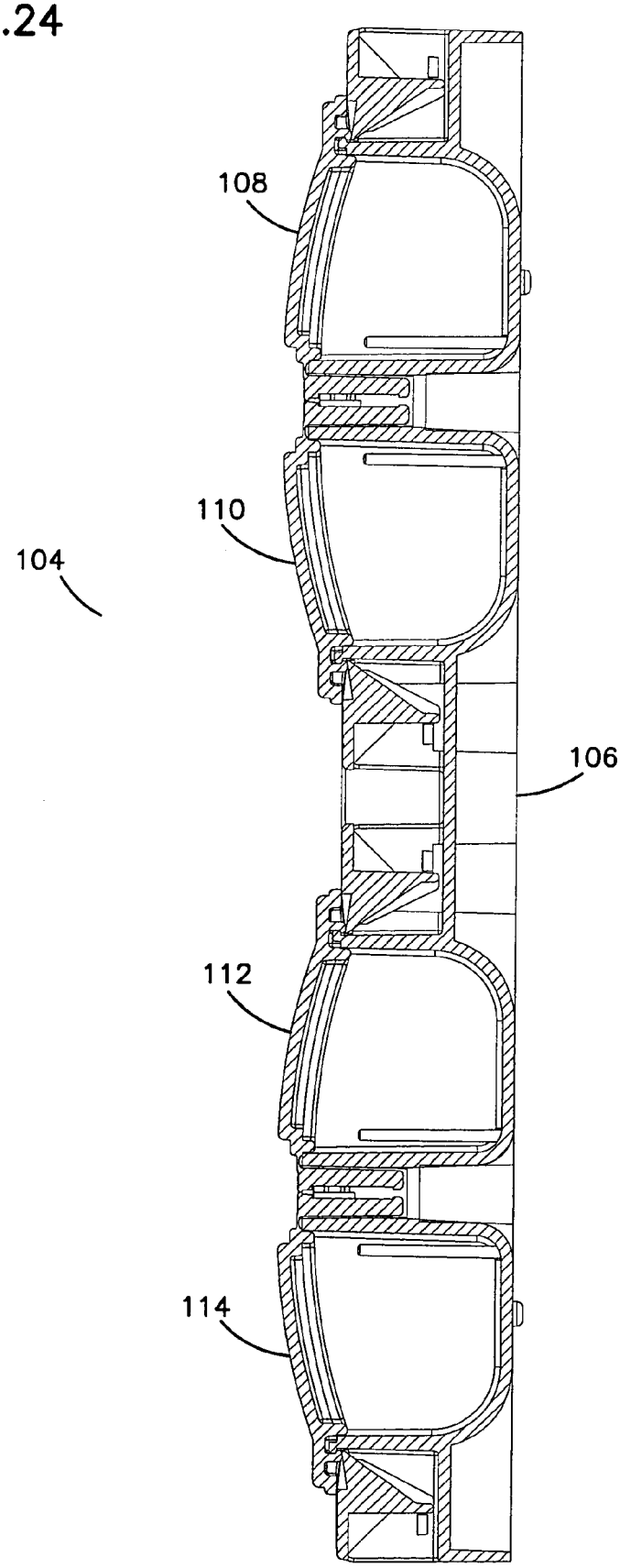
FIG. 24 is a cross-sectional view of the container along line 24-24 of FIG. 23.
Figure 25:
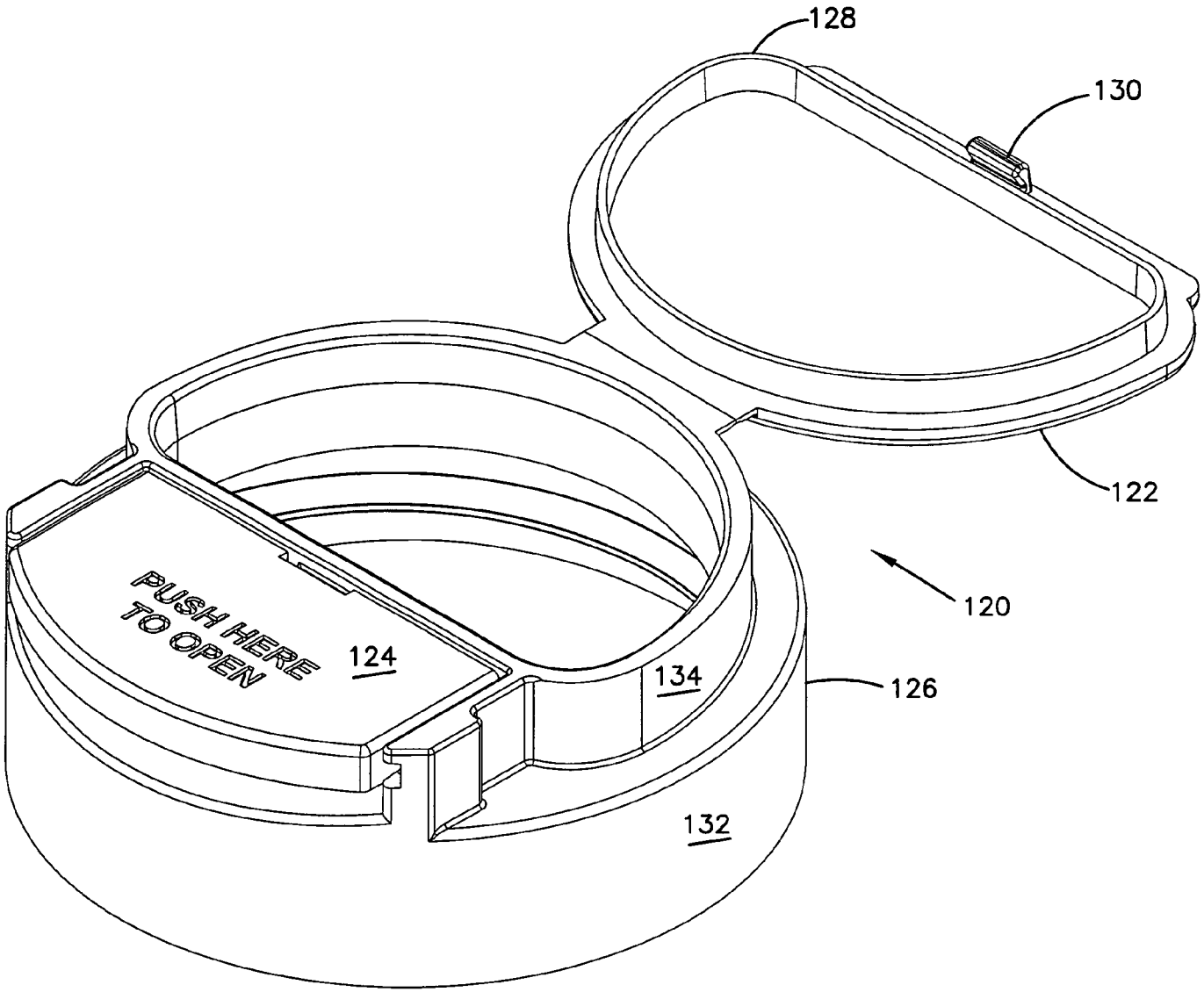
FIG. 25 is a perspective view of a lid assembly according to a fifth embodiment of the present disclosure.
Figure 26:
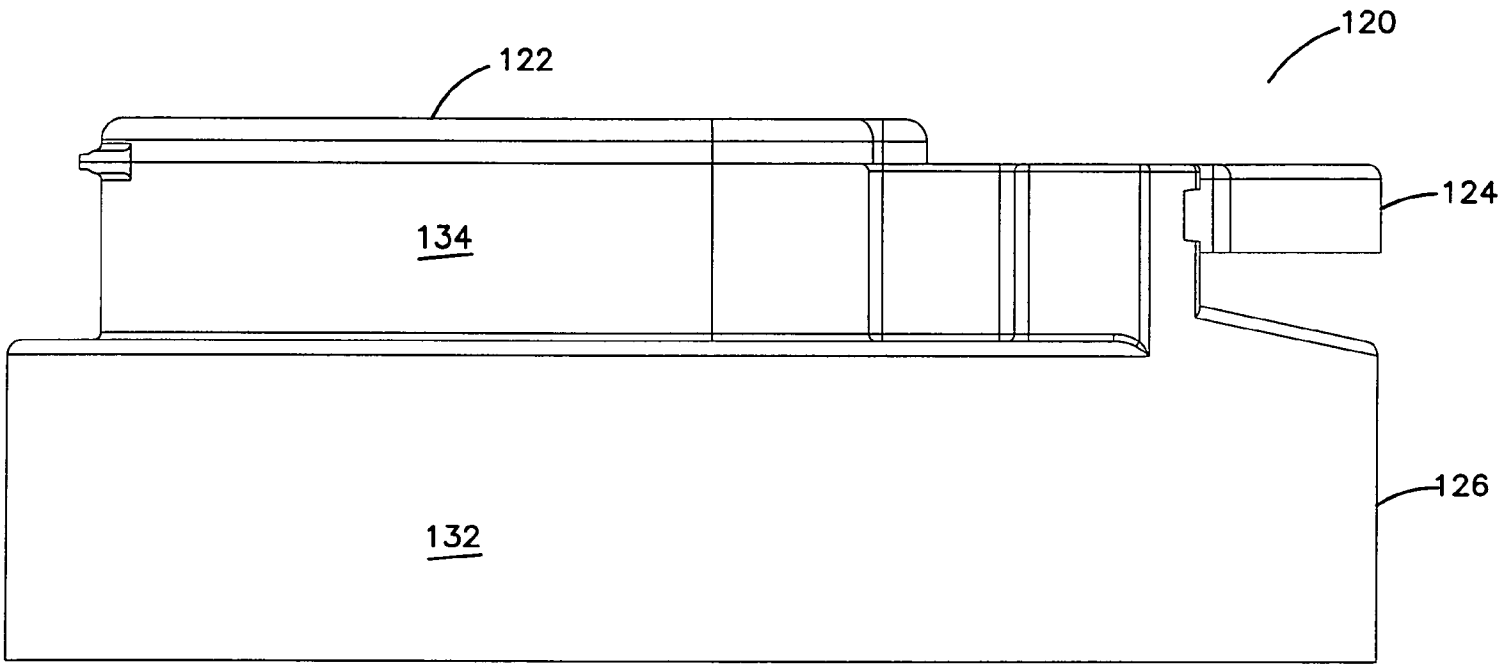
FIG. 26 is a side view of the lid assembly of FIG. 25 in a closed position.
Figure 27:
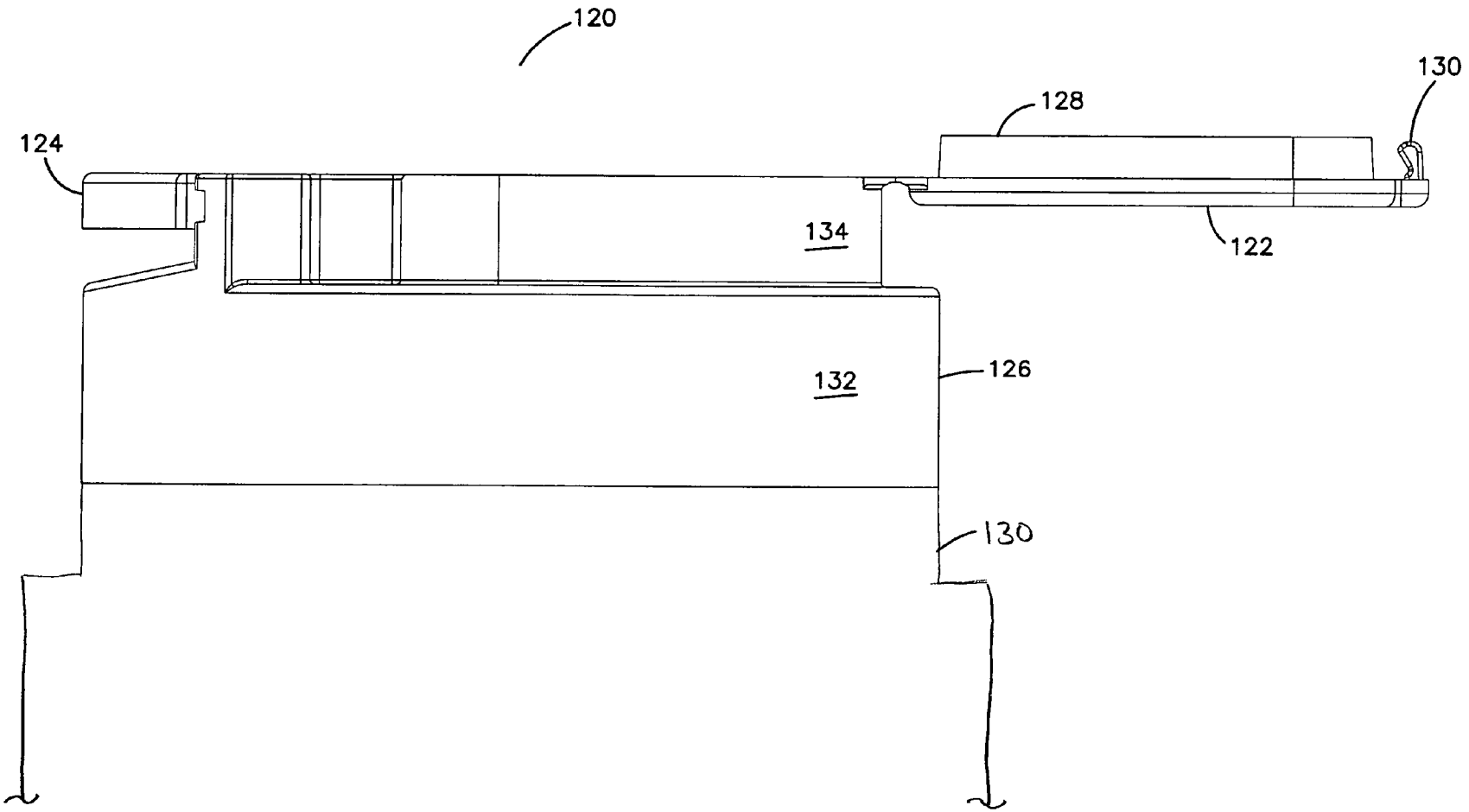
FIG. 27 is a side view of the lid assembly of FIG. 25 in an open position.
Figure 28:
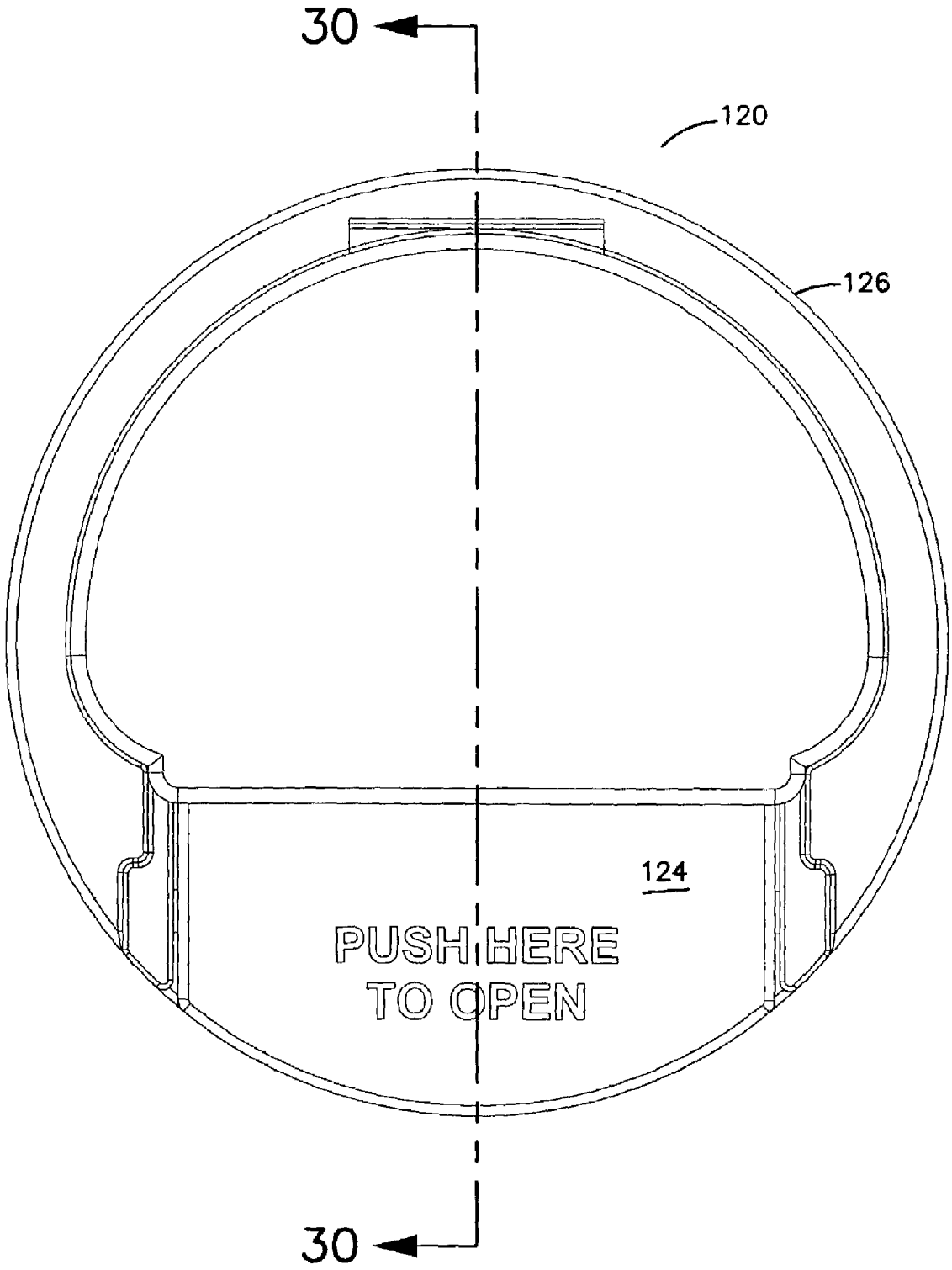
FIG. 28 is a top view of the lid assembly of FIG. 25 in a closed position.
Figure 29:
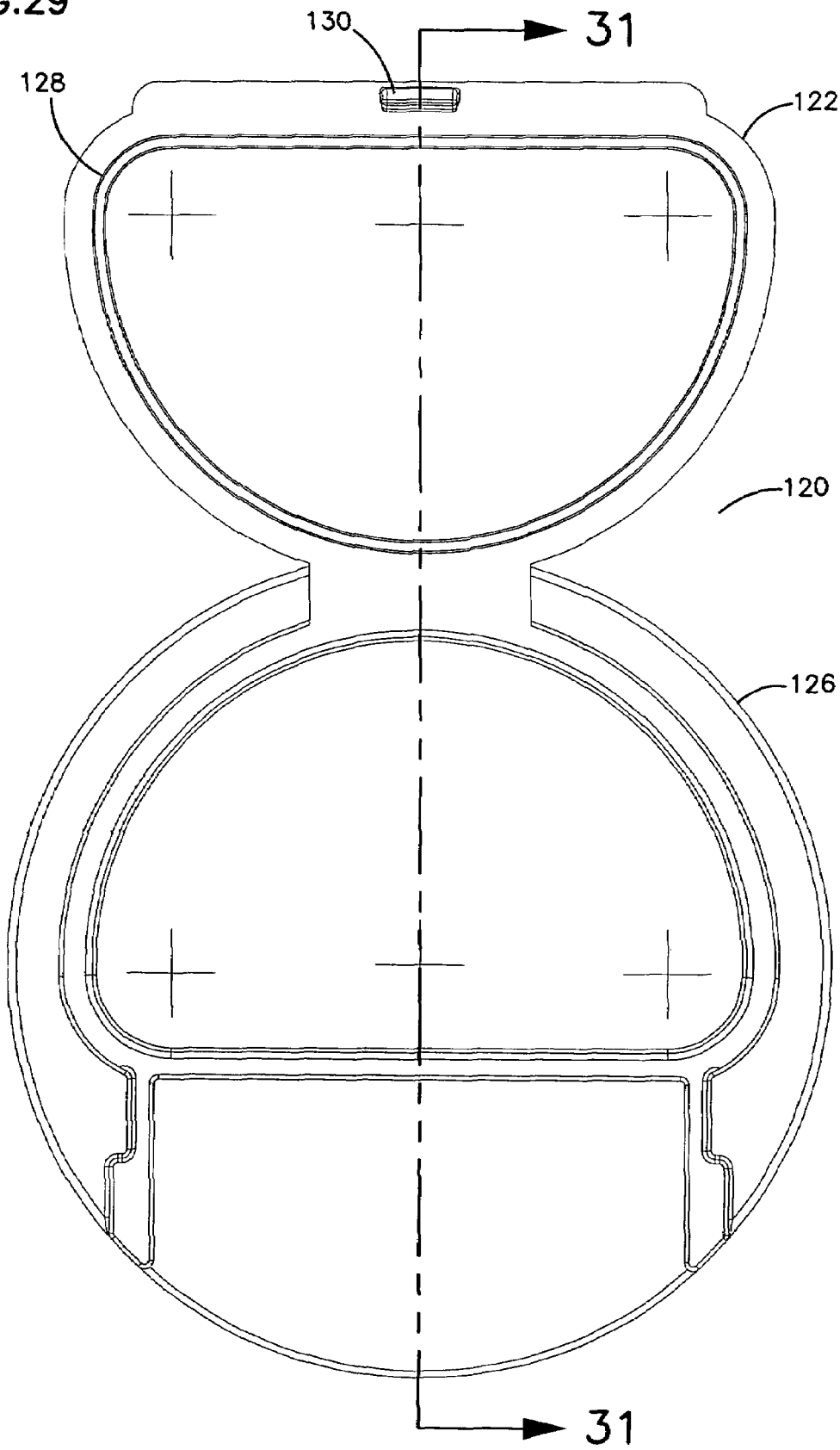
FIG. 29 is a top view of the lid assembly of FIG. 25 in an open position with the tab removed.
Figure 30:
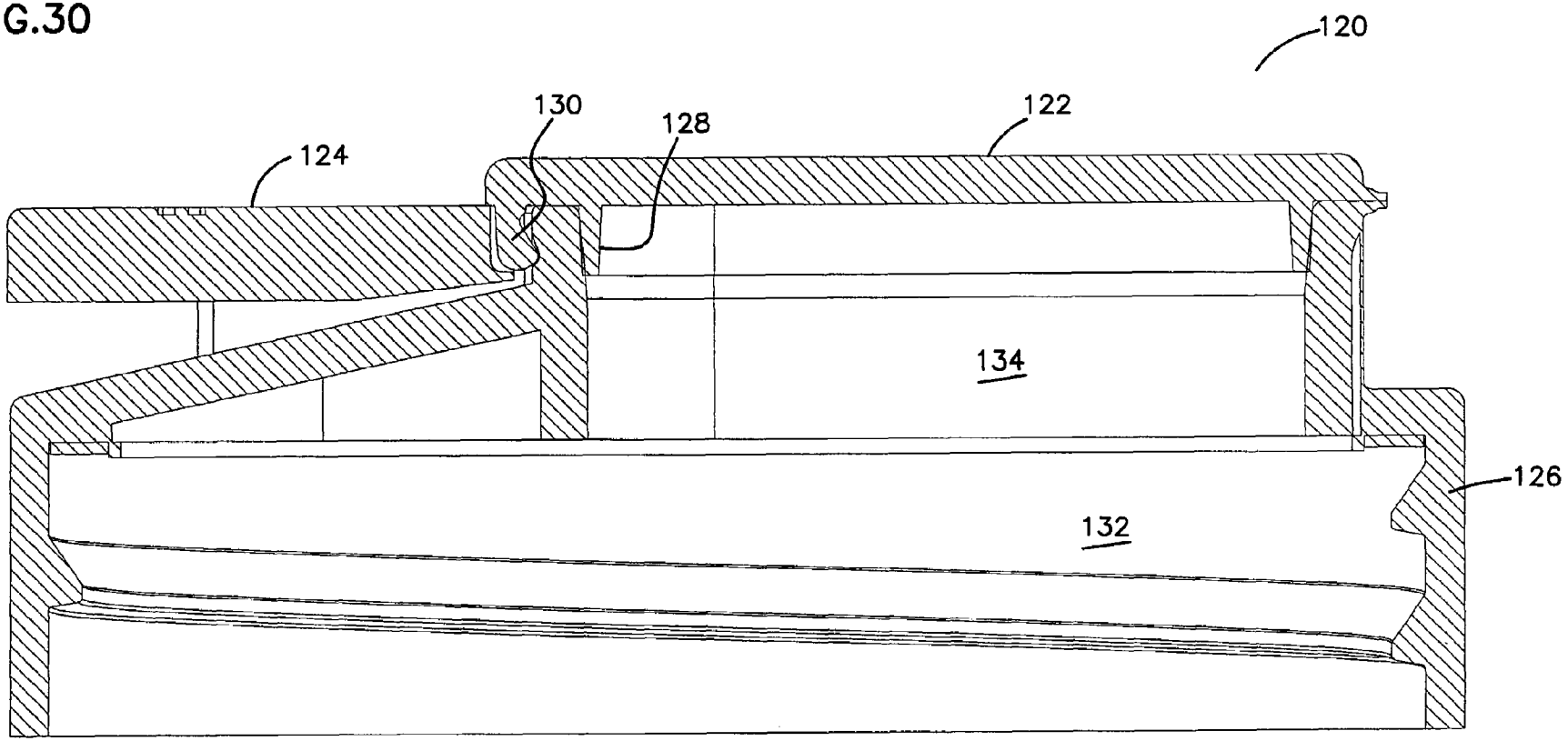
FIG. 30 is a cross-sectional view of the lid assembly along line 30-30 of FIG. 28.
Figure 31:
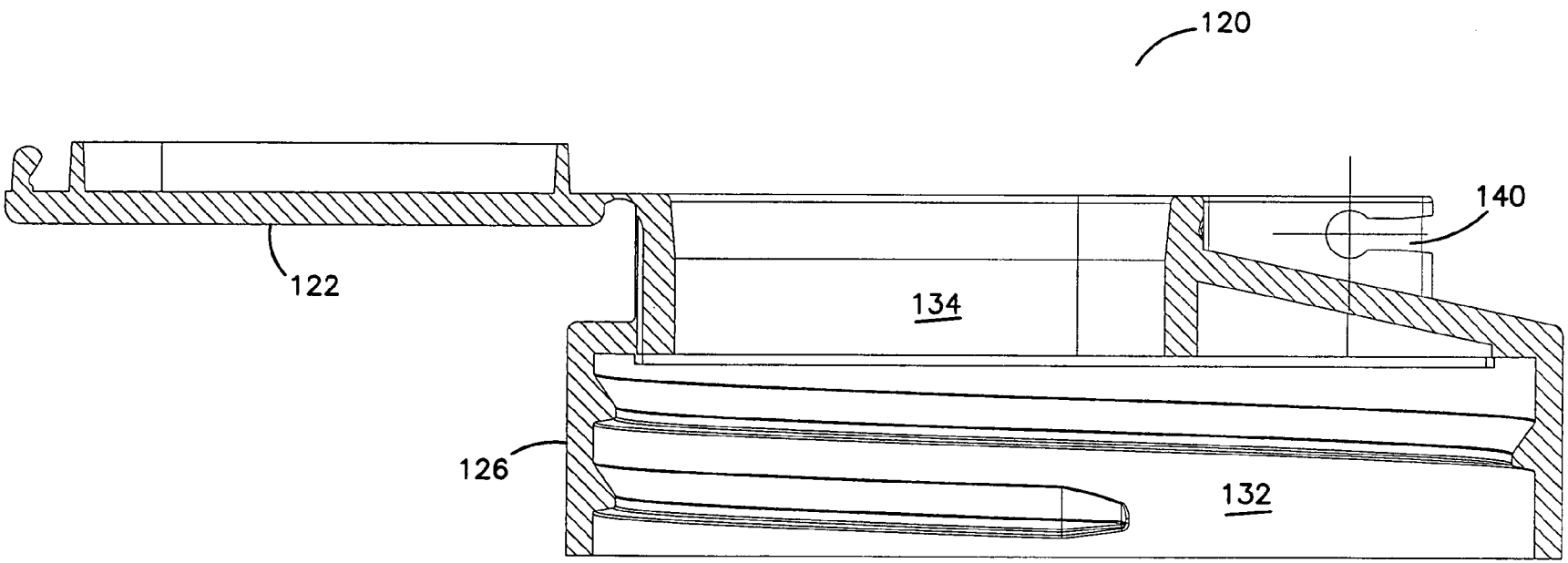
FIG. 31 is a cross-sectional view of the lid assembly along line 31-31 of FIG. 29.
Figure 32:
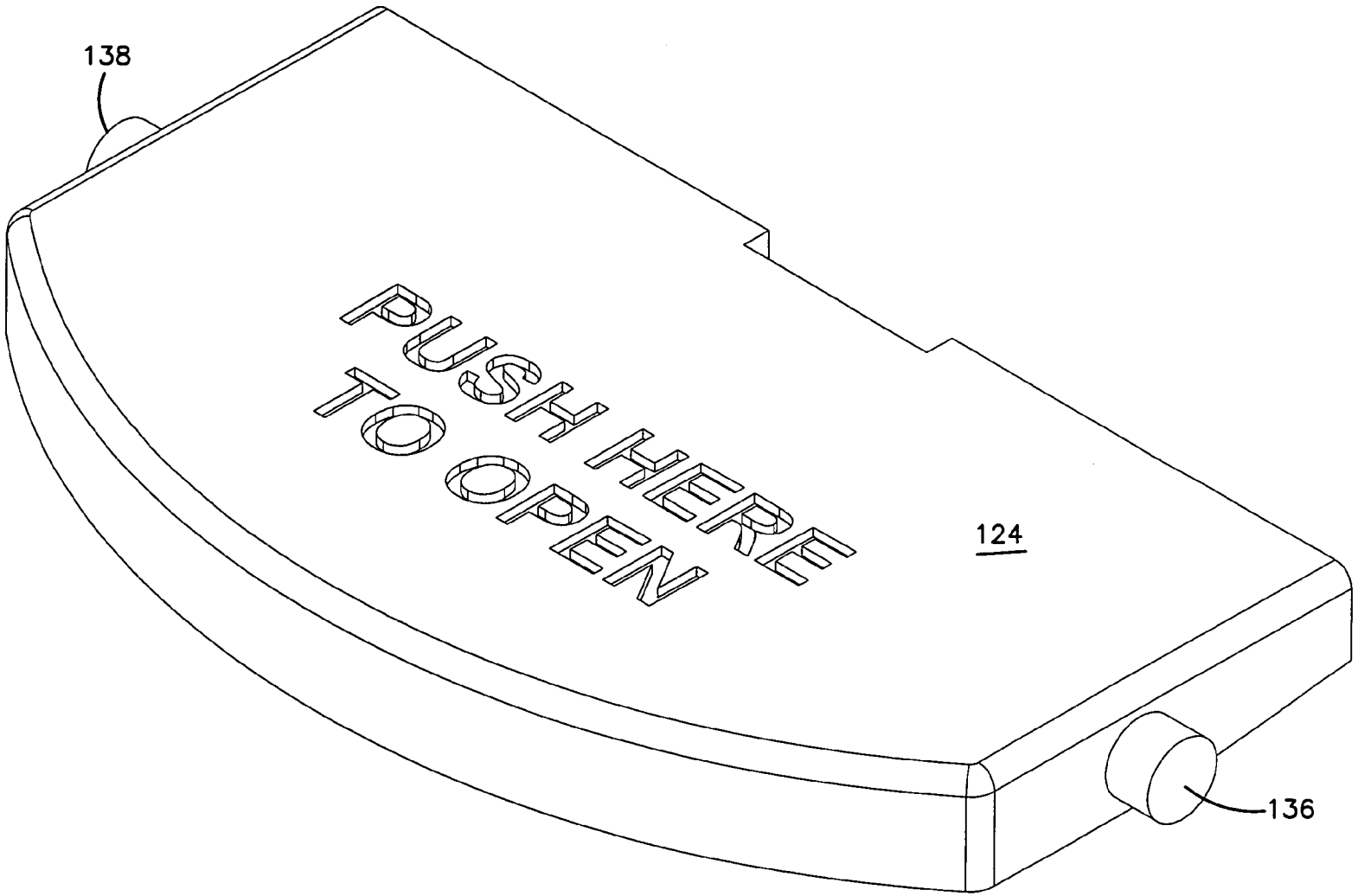
FIG. 32 is a perspective view of the tab of the lid assembly of FIG. 25.

Referring to FIGS. 14-16, a seven-compartment container 80 according to a second embodiment of the present disclosure is described. In the depicted embodiment, the container 80 is configured to store one week's worth of pills. The lids 81-87 are marked with the first letter of the day of the week as well as with raised bumps in particular orientations. The raised bumps can employ the braille coding system for marking the dates of the weeks. FIG. 15 shows the seven-compartment container 80 in an open position. FIG. 16 depicts a section of the seven compartment container showing a portion of a vertical guard wall 88, horizontal guard wall 91, stop 89, and tab 90.

Referring to FIGS. 17-20 a 14-compartment container 92 according to a third embodiment of the present disclosure is described. In the depicted embodiment, the 14-compartment container 92 is configured to store two weeks worth of pills. The fourteen compartment container 92 is similar to the seven-compartment container 80 and the two-compartment container 10. One difference is that the lids 96, 98 are not integral with the base 94. Instead, the lids 96, 98 are separate components that are connected to the base 94. The lids 96, 98 include a connector strip 100 that connects a number of individual covers or caps together. The connector strip 100 includes recesses and protrusions thereon. The connector strip 100 fits within a channel 102 in the base. In the depicted embodiment two connectors strips 100 are fitted together back-to-back and are slidably snapped into engagement with the channel 102.

Referring to FIGS. 21-24 a 28-compartment container 104 is described. The 28-compartment container 104 is configured to store at least two types of pills. For each day of the week, two compartments are designated to store evening pills, one compartment is for storing bedtime pills, and another compartment is for storing noon pills. The twenty eight compartment container 104 includes a base 106 that is connected to four rows of lids 108, 110, 112, and 114.

Referring to FIGS. 25-32 a lid assembly 120 according to a fifth embodiment of the present disclosure is described. In the depicted embodiment, the lid assembly 120 is configured to connect to the open end of a bottle 130. The lid assembly 120 includes a hinged lid 122, a tab 124, and a base 126. The lid includes an inner periphery lip 128 that fits within the opening of the base 126 and a lock arm member 130 that includes hook member. The base 126 includes a cylinder shaped threaded lower portion 132 and an upper portion 134 that mates with the lid 122 and supports the tab 124. The upper portion 134 includes two opposed side walls that include channels 140 that pivotally support opposed protrusions 136 on the tab 124. The tab 124 is arranged such that depressing the tab 124 releases the lid 122 from the locked position.

It should be appreciated that many alternative embodiments of the lid assembly are possible. Some alternative embodiments may include combining different features from any one of the above described embodiments. For example the first through fourth embodiments can include the circular shaped lids disclosed of the fifth embodiment or the rectangular lids of the first through fourth embodiment can replace the circular shaped lids of the fifth embodiment. Also, the lids of the fifth embodiment could include standoffs shown in the first through fourth embodiments or the single lid of the fifth embodiment can be replaced with multiple lids. Moreover, in alternative embodiments the lids can be attached to the bases differently (e.g., different hinge arrangements, different sealing arrangements, etc.). For example, in some embodiments the lids can form a water tight seal with the base when in a closed state.

Some embodiment are directed to a container that includes a base, a cap and a tab. The base defines a cavity that includes a front portion and a back portion. The cap is configured to mate with the base. The cap includes a first end secured to the back portion of the base and a second end configured to engage the front portion of the base. The tab is pivotally connected to the front portion of the base and is configured and arranged such that depressing a portion of the tab disengage the second end of the cap from the front portion of the base and positions the cap in an open state.

Other embodiments are directed at a multiple compartment container that includes a base, a first lid, a first actuator, and a second actuator. The base defines at least a first compartment and a second compartment, wherein the first and second compartments are separated by a partition. The first lid includes a pivot end and a free end. The second lid includes a pivot end and a free end, the second lid being configured such that it can be in an open position when the first lid is in a closed position. The first actuator is connected to the base, and includes a first portion and a second portion, wherein the first portion is covered by the first lid when the first lid is in a locked position. The second actuator is connected to the base and includes a first portion and a second portion, wherein the first portion of the second actuator is covered by the second lid when the second lid is in a locked position. The first actuator is configured to release the first lid from the locked position when the second portion of the first actuator is depressed, and the second actuator is configured to release the second lid from the locked position when the second portion of the second actuator is depressed.

Still other embodiments are directed a lid assembly configured for use with a bottle. The lid assembly includes a base portion, a cap, and a tab. The base portion defines an opening figured to mate with the bottle, and includes a front portion and a back portion. The cap is configured to mate with the base portion and includes a first end secured to the back portion of the base portion and a second end configured to engage the front portion of the base portion. The tab is pivotally connected to the front portion of the base portion and is configured and arranged such that depressing a portion of the tab disengage the second end of the cap from the front portion of the base portion and positions the cap in an open state.

The present disclosure is also directed at a method of storing and dispensing pills from a pill container. The method includes placing one or more pills within separate pill compartments in a single pill container, depressing a lid corresponding to the pill compartment to lock the one or more pills within a pill compartment, and depressing a tab adjacent the lid to unlock the one or more pills within the pill compartment.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A container comprising:

a base having a front wall, a real wall, and defining a cavity between the front wall and the rear wall, the cavity including a front portion and a back portion;

a cap configured to mate with the base and movable between an open position and a closed position, the cap including a first end secured adjacent to the back wall of the base and a second end opposite the first end, the second end including one of an engagement arm and a catch engaging the other of an engagement arm and a catch on the front wall of the base when the cap is in the closed position; and a tab pivotally connected to the base at a location opposite the front wall from the cavity, wherein the tab is configured and arranged such that depressing a front portion of the tab causes a rear portion of the tab to contact the cap to disengage the second end of the cap from the front wall of the base and thereby position the cap in the open position.

2. The container of claim 1, wherein the second end of the cap includes a lip that engages an inside surface of the front wall of the base.

3. The container of claim 2, wherein the second end of the cap includes the engagement arm and the front wall of the base includes the catch located on an outside surface of the front wall, and wherein the engagement arm includes a hook that engages the catch.

4. The container of claim 2, wherein the tab includes a lifter positioned between a pivot axis of the tab and the lip of the cap, the lifter configured to contact the engagement arm when the tab is pivoted about the pivot axis.

5. The container of claim 2, wherein the tab includes a lifter positioned between a pivot axis of the tab and the lip of the cap, the lifter configured to contact an underside of the cap when the tab is depressed.

6. The container of claim 1, wherein the tab includes a first end and a second end, each end including a recessed portion that is configured to engage a pair of opposed protrusions on the front end of the base.

7. The container of claim 6, wherein the tab includes a lifter between a pivot axis and the back of the base, the lifter configured to contact a portion of the cap when the tab is pivoted about the pivot axis.

8. The container of claim 7, wherein the lifters are at least partially covered by the cap when the cap is mated with the base.

9. The container of claim 1, wherein the base defines multiple separate cavities, and wherein the container further comprises a cap and a tab for each of the multiple cavities, wherein each of the caps are configured to open and close independently.

10. The container of claim 9, wherein the multiple caps are connected by a common connection strip, wherein the connection strip is configured to interlock with the base.

11. The container of claim 9, wherein the multiple caps are each separately attached to the base via a living hinge.

12. The container of claim 1, wherein the tab is connected adjacent a front of the base such that when the tab rotates in a clockwise direction the lid rotates in a counter clockwise direction.

13. A multiple compartment container comprising:

a base having a front wall, a rear wall, and defining at least a first compartment and a second compartment, wherein the first and second compartments are separated by a partition;

a first lid including a pivot end secured adjacent to the rear wall of the base and a free end movable between an open position spaced from the front wall of the base and a locked position, wherein one of a first lock arm and a first catch disposed on the free end of the first lid engages the other of a first lock arm and a first catch disposed on the front wall of the base to position the first lid in the locked position;

a second lid including a pivot end secured adjacent to the rear wall of the base and a free end movable between an open position spaced from the front wall of the base and a locked position, wherein one of a second lock arm and a second catch disposed on the free end of the second lid engages the other of a second lock arm and a second catch disposed on the front wall of the base to position the second lid in the locked position;

a first actuator pivotally connected to the base at a location opposite the front wall from the first compartment, the first actuator including a first portion and a second portion, wherein the first portion is covered by the first lid when the first lid is in the locked position;

a second actuator pivotally connected to the base at a location opposite the front wall from the second compartment, the second actuator including a first portion and a second portion, wherein the first portion of the second actuator is covered by the second lid when the second lid is in the locked position;

wherein the first actuator is configured to release the first lid from the locked position when the second portion of the first actuator is depressed by causing the first portion of the first actuator to engage and dislocate the first lid from the front wall, and wherein the second actuator is configured to release the second lid from the locked position when the second portion of the second actuator is depressed by causing the first portion of the second actuator to engage and dislocate the second lid from the front wall.

* * * * *